US007247072B2

(12) United States Patent
Yokota et al.

(10) Patent No.: US 7,247,072 B2
(45) Date of Patent: Jul. 24, 2007

(54) METHOD OF MANUFACTURING AN IMAGE DISPLAY APPARATUS BY SUPPLYING CURRENT TO SEAL THE IMAGE DISPLAY APPARATUS

(75) Inventors: Masahiro Yokota, Fukaya (JP); Takashi Enomoto, Fukaya (JP); Takashi Nishimura, Fukaya (JP); Akiyoshi Yamada, Fukaya (JP); Shouichi Yokoyama, Fukaya (JP)

(73) Assignee: Kabushiki Kaisha Toshiba, Tokyo (JP)

( * ) Notice: Subject to any disclaimer, the term of this patent is extended or adjusted under 35 U.S.C. 154(b) by 0 days.

(21) Appl. No.: 10/690,744

(22) Filed: Oct. 23, 2003

(65) Prior Publication Data

US 2004/0080261 A1 Apr. 29, 2004

Related U.S. Application Data

(63) Continuation of application No. PCT/JP02/03994, filed on Apr. 22, 2002.

(30) Foreign Application Priority Data

| | | |
|---|---|---|
| Apr. 23, 2001 | (JP) | 2001-124685 |
| Aug. 27, 2001 | (JP) | 2001-256313 |
| Oct. 15, 2001 | (JP) | 2001-316921 |
| Oct. 23, 2001 | (JP) | 2001-325370 |
| Oct. 29, 2001 | (JP) | 2001-331234 |

(51) Int. Cl.
*H01J 9/26* (2006.01)

(52) U.S. Cl. ..... 445/24; 445/25

(58) Field of Classification Search ..... 445/23–25, 445/43, 44

See application file for complete search history.

(56) References Cited

U.S. PATENT DOCUMENTS

| | | | | |
|---|---|---|---|---|
| 3,645,817 | A * | 2/1972 | Walker et al. | 156/108 |
| 3,748,543 | A * | 7/1973 | Roberson | 257/778 |
| 5,674,351 | A * | 10/1997 | Lovoi | 315/167 |

(Continued)

FOREIGN PATENT DOCUMENTS

JP 62-285340 12/1987

(Continued)

OTHER PUBLICATIONS

International Search Report Apr. 4, 2003.

*Primary Examiner*—Karabi Guharay
*Assistant Examiner*—Dalei Dong
(74) *Attorney, Agent, or Firm*—Oblon, Spivak, McClelland, Maier & Neustadt, P.C.

(57) ABSTRACT

An image display apparatus includes an envelope which has a front substrate and a rear substrate opposed to each other and individually having peripheral edge portions sealed together. A sealed portion is sealed by a sealing member. the sealing member has electrical conductivity and melts when supplied with current. After the sealing member in the sealed portion is supplied with current and melted during manufacture, the current supply is stopped to cool and solidify the sealing member, whereupon the respective peripheral edge portions of the front substrate and the rear substrate are selected together.

15 Claims, 20 Drawing Sheets

U.S. PATENT DOCUMENTS

| | | | | | |
|---|---|---|---|---|---|
| 5,697,825 | A | * | 12/1997 | Dynka et al. | 445/25 |
| 5,827,102 | A | * | 10/1998 | Watkins et al. | 445/25 |
| 6,392,334 | B1 | * | 5/2002 | Alwan | 313/422 |
| 6,592,419 | B2 | * | 7/2003 | Alwan | 445/24 |
| 6,724,143 | B2 | * | 4/2004 | Chen et al. | 313/512 |
| 6,840,833 | B1 | * | 1/2005 | Motowaki et al. | 445/25 |

FOREIGN PATENT DOCUMENTS

| | | | | |
|---|---|---|---|---|
| JP | 04-032132 | | | 2/1992 |
| JP | 7-290745 | | | 11/1995 |
| JP | 10-279887 | | | 10/1998 |
| JP | 2000-138029 | | | 5/2000 |
| JP | 2000-143262 | | | 5/2000 |
| JP | 2000138029 | A | * | 5/2000 |
| JP | 2000-200543 | | | 7/2000 |
| JP | 2000-251722 | | | 9/2000 |
| JP | 2000-251768 | | | 9/2000 |
| JP | 2000-251793 | | | 9/2000 |
| JP | 2000-260304 | | | 9/2000 |
| JP | 2000251768 | A | * | 9/2000 |
| JP | 2001-229825 | | | 8/2001 |

* cited by examiner

FIG.26
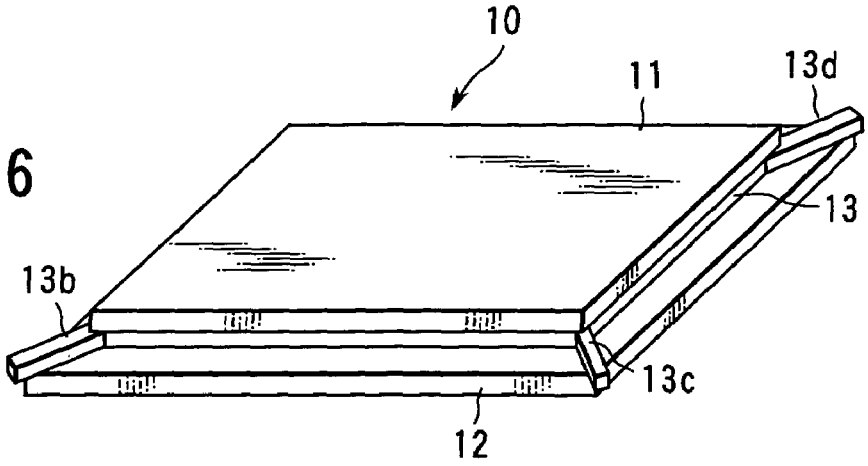
FIG.27
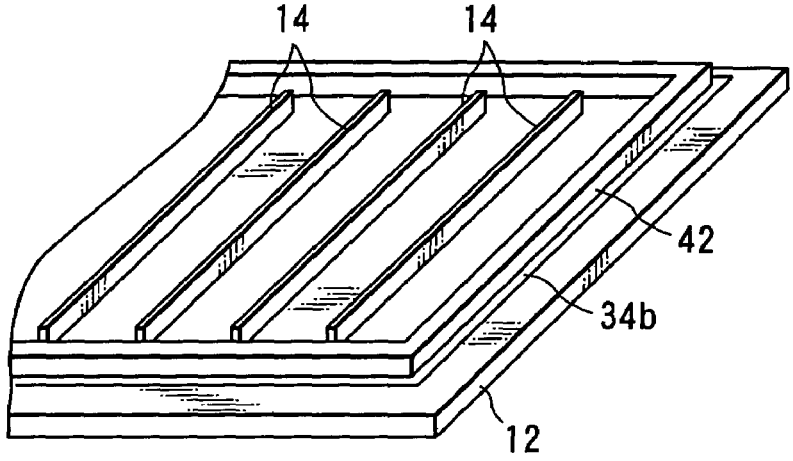
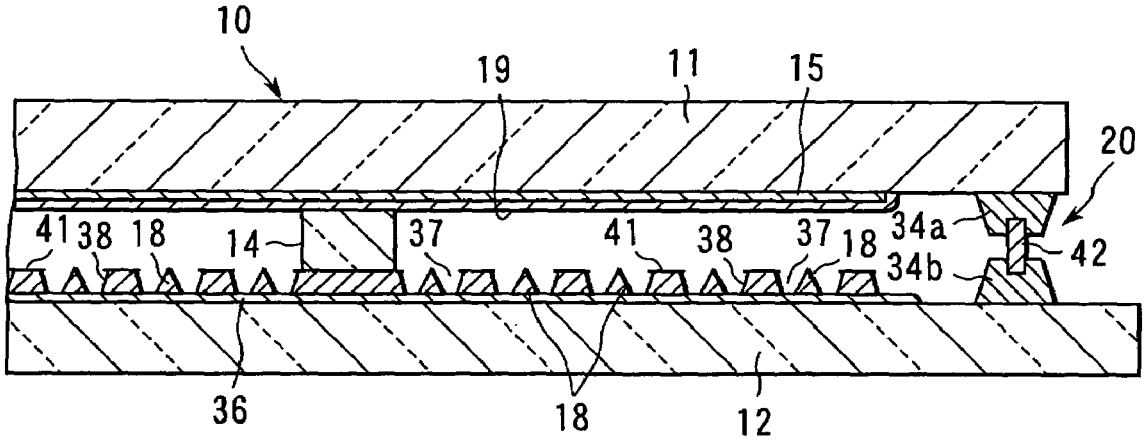
FIG.28

METHOD OF MANUFACTURING AN IMAGE DISPLAY APPARATUS BY SUPPLYING CURRENT TO SEAL THE IMAGE DISPLAY APPARATUS

CROSS-REFERENCE TO RELATED APPLICATIONS

This is a Continuation Application of PCT application No. PCT/JP02/03994, filed Apr. 22, 2002, which was not published under PCT Article 21(2) in English.

This application is based upon and claims the benefit of priority from the prior Japanese Patent Applications No. 2001-124685, filed Apr. 23, 2001; No. 2001-256313, filed Aug. 27, 2001; No. 2001-316921, filed Oct. 15, 2001; No. 2001-325370, filed Oct. 23, 2001; and No. 2001-331234, filed Oct. 29, 2001, the entire contents of all of which are incorporated herein by reference.

BACKGROUND OF THE INVENTION

1. Field of the Invention

This invention relates to an image display apparatus having a flat shape, and more particularly, to an image display apparatus provided with a number of electron emitting elements in a vacuum envelope and a manufacturing method and a manufacturing apparatus for the image display apparatus.

2. Description of the Related Art

Recently, various flat display apparatuses have been developed as a next generation of lightweight, thin image display apparatuses to replace cathode-ray tubes (hereinafter referred to as CRT). These flat display apparatuses include a liquid crystal display (hereinafter referred to as LCD), plasma display panel (hereinafter referred to as PDP), field emission display (hereinafter referred to as FED), surface-conduction electron emission display (hereinafter referred to as SED), etc. In the LCD, the intensity of light is controlled by utilizing the orientation of a liquid crystal. In the PDP, phosphors are caused to glow by ultraviolet rays that are produced by plasma discharge. In the FED, phosphors are caused to glow by electron beams that are emitted from field-emission electron emitting elements. In the SED, phosphors are caused to glow by electron beams that are emitted from surface-conduction electron emitting elements.

In general, the FED or SED, for example, has a front substrate and a rear substrate that are opposed to each other with a given gap between them. These substrates have their respective peripheral portions bonded together by means of a sidewall in the form of a rectangular frame, thereby constituting a vacuum envelope. A phosphor screen is formed on the inner surface of the front substrate. A number of electron emitting elements (hereinafter referred to as emitters) for use as sources of electron emission for exciting the phosphors to luminescence are provided on the inner surface of the rear substrate. In order to support atmospheric load that acts on the front substrate and the rear substrate, a plurality of support members are arranged between the substrates. The potential on the rear substrate side is substantially equal to the earth potential, and an anode voltage Va is applied to the phosphor screen. Electron beams that are emitted from the emitters are applied to red, green, and blue phosphors that constitute the phosphor screen, whereupon the phosphor layers are caused to glow, thereby displaying an image.

According to the FED or SED constructed in this manner, the thickness of the apparatus can be reduced to several millimeters. Therefore, the FED or SED can be made thinner and lighter in weight than a CRT that is used as a display of an existing TV set or computer.

In the FED or SED described above, moreover, a high vacuum must be formed in the envelope. Also in the PDP, the envelope must be evacuated before it is loaded with discharge gas.

As means for evacuating the envelope, there is a method in which the front substrate, rear substrate, and sidewall that constitute the envelope are heated and joined together by a suitable sealing material in the atmosphere. After the envelope is then exhausted through an exhaust pipe that is attached to the front or rear substrate, in this method, the exhaust pipe is vacuum-sealed. In the case of a flat envelope, however, the exhaust through the exhaust pipe is very slow, and the attainable degree of vacuum is low. Thus, the mass-productivity and properties are not reliable.

In another method, the front substrate and the rear substrate that constitute the envelope may be finally assembled in a vacuum tank. In this method, the front substrate and the rear substrate that are first brought into the vacuum tank are fully heated in advance. This is done in order to reduce the gas discharge from the inner wall of the envelope that constitutes the principal cause of lowering of the degree of vacuum. When the front substrate and the rear substrate are then cooled so that the degree of vacuum in the vacuum tank is fully improved, a getter film for improving and maintaining the degree of vacuum of the envelope is formed on the phosphor screen. Thereafter, the front substrate and the rear substrate are heated again to a temperature high enough to melt the sealing material. The front substrate and the rear substrate are combined together in a predetermined position as they are cooled so that the sealing material is solidified.

For the vacuum envelope constructed by this method, a sealing process doubles as a vacuum-sealing process. Besides, a lot of time that is required by the exhaust through the exhaust pipe can be saved, and a high degree of vacuum can be obtained.

In this assembly in a vacuum, however, processing in the sealing process involves various operations, such as heating, position alignment, and cooling, and the front substrate and the rear substrate must be kept in the predetermined position for a long period of time before the sealing material is melted and solidified. Since the front substrate and the rear substrate undergo thermal expansion as they are heated and cooled in the sealing operation, moreover, the alignment accuracy easily lowers. Thus, the sealing operation entails problems on productivity and properties.

BRIEF SUMMARY OF THE INVENTION

This invention has been contrived in consideration of these circumstances, and its object is to provide an image display apparatus, of which an envelope can be easily assembled, and a manufacturing method and a manufacturing apparatus for the image display apparatus.

In order to achieve the above object, an image display apparatus according to an aspect of this invention and a manufacturing method for the apparatus comprise an envelope which has a front substrate and a rear substrate opposed to each other and individually having peripheral edge portions sealed together, a sealed portion between the front substrate and the rear substrate being sealed by a sealing member which has electrical conductivity and melts when supplied with current. The sealing member on the sealed portion is melted to seal the sealed portion in a manner such that current is supplied to the sealing member.

According to the image display apparatus constructed in this manner and the manufacturing method, only the sealing member is mainly heated and melted by heat that is generated as current is supplied to the sealing member. If the current supply is stopped immediately after the sealing member is melted, heat from the sealing member is quickly diffusively conducted to the front substrate and the rear substrate, whereupon the sealing member is cooled and solidified. Thus, a sealing process requires no heating device for generally heating the front substrate and the rear substrate, and moreover, the time for the sealing process can be shortened considerably. Besides, thermal expansion of the front substrate and the rear substrate can be minimized, so that lowering of the positional accuracy of the substrates can be improved as they are sealed together.

Further, an image display apparatus according to another aspect of this invention comprises an envelope which has a front substrate, a rear substrate opposed to the front substrate, and a sealed portion between respective peripheral edge portions of the front substrate and the rear substrate. The sealed portion has an electrically conductive sealing material which is heated and melted to seal the peripheral edge portions when supplied with current, and a conductive member having a melting point higher than that of the sealing material and located on the peripheral edge portions.

According to the image display apparatus described above, the electrically conductive sealing material is heated and melted when current is supplied to the conductive member and the sealing material. If the current supply is stopped, the sealing material is cooled and solidified, whereupon the respective peripheral edge portions of the front substrate and the rear substrate are sealed together. Since the sealing material is directly heated by the current supply in this manner, the sealing material can be melted in a short time. If the conductive member is made thick enough, it cannot be broken even though the current supply is increased to shorten the melting time. Since the front substrate and the rear substrate need not be heated, moreover, thermal expansion and thermal contraction of the substrates can be prevented. Thus, the positional accuracy can be improved when the substrates are sealed together.

An image display apparatus according to another aspect of this invention comprises an envelope which has a front substrate and a rear substrate opposed to each other and a sealed portion between the respective peripheral portions of the front substrate and the rear substrate. The sealed portion includes a sealing material and a high-melting conductive member in the form of a rectangular frame. The high-melting conductive member has a melting point higher than that of the sealing material and has four or more projecting portions protruding outward therefrom.

An image display apparatus according to still another aspect of this invention comprises an envelope which has a front substrate and a rear substrate opposed to each other and a sealed portion between the respective peripheral portions of the front substrate and the rear substrate, a phosphor screen formed on the inner surface of the front substrate, and a source of electron emission which is located on the rear substrate and emits an electron beam to the phosphor screen, thereby causing the phosphor screen to glow. The sealed portion includes a sealing material and a high-melting conductive member in the form of a rectangular frame. The high-melting conductive member has a melting point higher than that of the sealing material and has four or more projections protruding outward therefrom.

A manufacturing method for an image display apparatus according to an aspect of this invention is a manufacturing method for an image display apparatus which comprises an envelope having a front substrate and a rear substrate opposed to each other and a sealed portion including a high-melting conductive member having a melting point higher than that of the sealing material and sealing together the respective peripheral portions of the front substrate and the rear substrate. The method comprises providing a rectangular frame-shaped high-melting conductive member having four or more projections protruding outward therefrom, locating the high-melting conductive member between the respective peripheral portions of the front substrate and the rear substrate and locating sealing materials individually between the front substrate and the high-melting conductive member and between the rear substrate and the high-melting conductive member, and supplying current to the high-melting conductive member through the projections, thereby melting the sealing materials and sealing together the respective peripheral portions of the front substrate and the rear substrate.

An image display apparatus according to another aspect of this invention comprises an envelope having a front substrate and a rear substrate opposed to each other and a sealed portion which seals together the respective peripheral portions of the front substrate and the rear substrate. The sealed portion includes a frame-shaped high-melting conductive member and first and second sealing materials. The first sealing material has a melting or softening point lower than that of the second sealing material, and the high-melting conductive member has a melting or softening point higher than those of the first and second sealing materials. The high-melting conductive member is bonded to one of the two substrates by means of the first sealing material and to the other of the substrates by means of the second sealing material.

Further, a manufacturing method for an image display apparatus according to still another aspect of this invention is a manufacturing method for an image display apparatus which comprises an envelope having a front substrate and a rear substrate opposed to each other and in which the respective peripheral portions of the front substrate and the rear substrate are sealed together by a sealed portion including a high-melting conductive member and first and second sealing materials. The method comprises providing a frame-shaped high-melting conductive member having a melting or softening point higher than those of the first and second sealing materials, bonding the high-melting conductive member to the peripheral portion of the front substrate or the rear substrate by means of the second sealing material having a melting or softening point higher than that of the first sealing material, opposing the one substrate to which the high-melting conductive member is bonded and the other substrate to each other and locating the first sealing material between the high-melting conductive member and the peripheral portion of the other substrate, and supplying current to the high-melting conductive member, thereby melting or softening the first sealing material and bonding together the high-melting conductive member and the other substrate.

An image display apparatus according to an aspect of this invention comprises an envelope having a front substrate and a rear substrate opposed to each other and a sealed portion which seals together the respective peripheral portions of the front substrate and the rear substrate. The sealed portion includes a frame-shaped high-melting conductive member and a sealing material. The high-melting conductive member has a melting or softening point higher than that of the sealing material and has elasticity in a direction perpendicular to the respective surfaces of the front substrate and the rear substrate.

Further, a manufacturing method for an image display apparatus according to another aspect of this invention is a manufacturing method for an image display apparatus which comprises an envelope having a front substrate and a rear substrate opposed to each other and in which the respective peripheral portions of the front substrate and the rear substrate are sealed together by means of a sealed portion including a high-melting conductive member and a sealing material. The method comprises providing a frame-shaped high-melting conductive member having a melting or softening point higher than that of the sealing material and having elasticity in a direction perpendicular to the respective surfaces of the front substrate and the rear substrate, opposing the front substrate and the rear substrate to each other and locating the high-melting conductive member and the sealing material between the respective peripheral portions of the front substrate and the rear substrate, lapping the opposed front and rear substrates on each other with the sealing material solidified and elastically deforming the high-melting conductive member in a direction perpendicular to the respective surfaces of the front substrate and the rear substrate, and supplying current to the high-melting conductive member with the front substrate and the rear substrate lapped on each other, thereby melting or softening the sealing material and sealing together the respective peripheral portions of the front substrate and the rear substrate.

According to the image display apparatus and the manufacturing method arranged in this manner, deflection of the substrates caused when the front substrate and the rear substrate are lapped on each other is improved by means of the elasticity of the high-melting conductive member, so that the front substrate and the rear substrate can be sealed together with improved alignment accuracy.

A manufacturing method for an image display apparatus according to an aspect of this invention is a manufacturing method for an image display apparatus which comprises an envelope, having a front substrate and a rear substrate opposed to each other and individually having peripheral portions bonded together, and a plurality of pixels formed in the envelope. The method comprises locating an electrically conductive sealing material on at least one of the front and rear substrates, supplying current to and heating and melting the sealing material to bond together the respective peripheral portions of the front substrate and the rear substrate, and controlling the current supply to the sealing material in accordance with the temperature dependence of the electrical resistance of the sealing material in heating the sealing material by the current supply.

Further, a manufacturing apparatus for an image display apparatus according to another aspect of this invention is a manufacturing apparatus for an image display apparatus which comprises an envelope, having a front substrate and a rear substrate opposed to each other and individually having peripheral portions bonded together, and a plurality of pixels formed in the envelope. The manufacturing apparatus comprises a power source which supplies current to and heat and melt a sealing material located on the peripheral portion of at least one of the front and rear substrates, and a control section which receives at least one of a current and voltage value fed back from the power source when the sealing material is heated by the current supply and controls the current supply to the sealing material from the power source in accordance with the temperature dependence of the electrical resistance of the sealing material.

According to the manufacturing method and the manufacturing apparatus for the image display apparatus constructed in this manner, the completion of melting of the sealing material can be electrically detected with ease in accordance with the temperature dependence of the electrical resistance of the sealing material. Thus, the front substrate and the rear substrate can be kept entirely at low temperature as their respective peripheral portions are bonded together, so that the adsorption capacity of a getter cannot be lowered. Further, the substrates can be prevented from being broken by thermal stress. Furthermore, the bonding can be easily accomplished in several minutes, so that the process time can be made shorter than in the conventional case. Thus, there may be provided an image display apparatus that can be manufactured at low cost and ensures stable, satisfactory images.

BRIEF DESCRIPTION OF THE SEVERAL VIEWS OF THE DRAWING

The accompanying drawings, which are incorporated in and constitute a part of the specification, illustrate an embodiment of the invention, and together with the general description given above and the detailed description of the embodiment given below, serve to explain the principles of the invention.

FIG. 26 is a perspective view showing an FED according to another modification of the fourth embodiment;

FIG. 27 is a perspective view showing an FED according to a fifth embodiment of this invention cleared of its front substrate;

FIG. 28 is a sectional view of the FED according to the fifth embodiment;

DETAILED DESCRIPTION OF THE INVENTION

A first embodiment of an image display apparatus of the present invention applied to an FED will now be described in detail with reference to the drawings.

Figure 1:
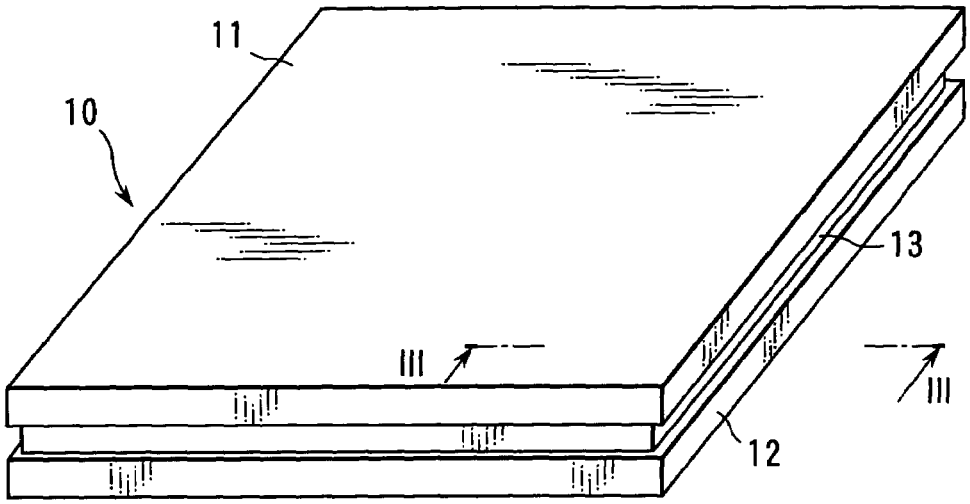
FIG. 1 is a perspective view showing the general configuration of an FED according to an embodiment of this invention.
Figure 2:
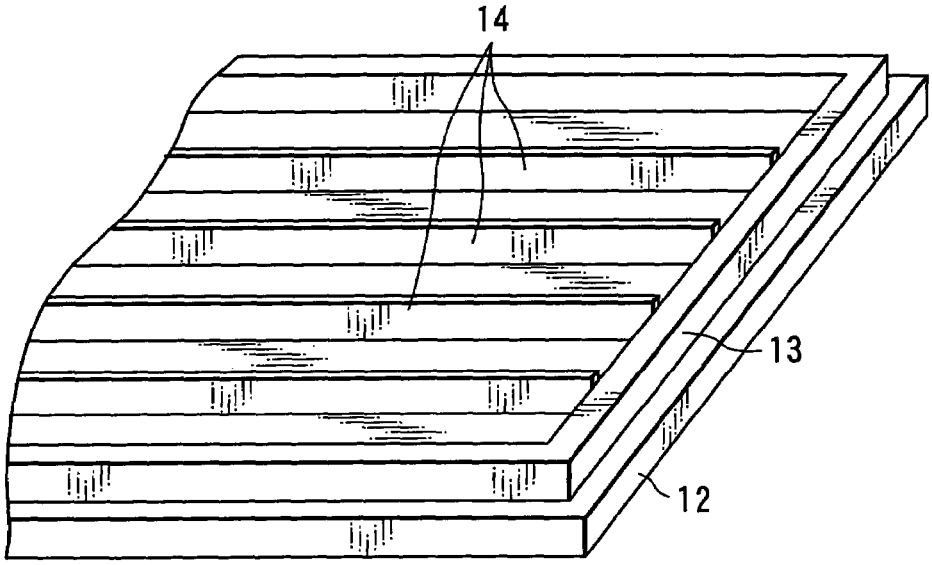
FIG. 2 is a perspective view showing the internal configuration of the FED.
Figure 3:
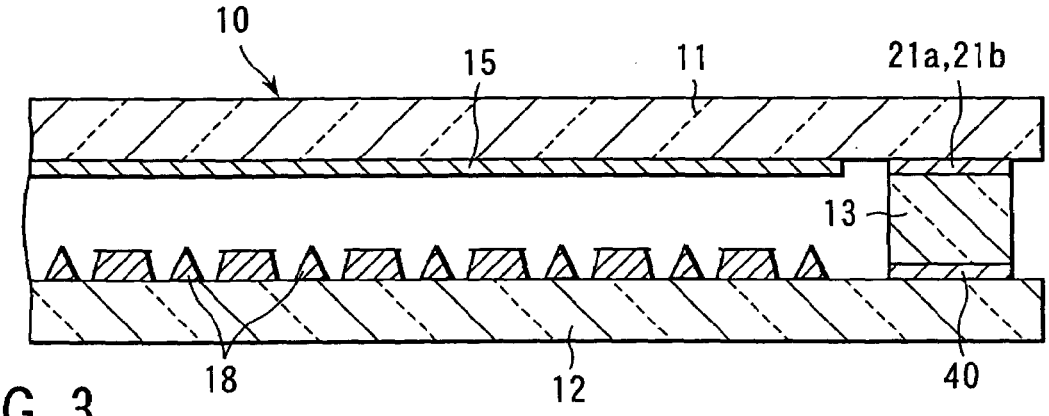
FIG. 3 is a sectional view taken along line III—III of FIG. 1.

As shown in FIGS. 1 to 3, this FED comprises a front substrate 11 and a rear substrate 12 as insulating substrates, which are formed of a rectangular glass material each. These substrates are opposed to each other with a gap of 1 to 2 mm between them. The front substrate 11 and the rear substrate 12 have their respective peripheral edge portions joined together through a sidewall 13 in the form of a rectangular frame, and constitute a flat, rectangular vacuum envelope 10 that is kept vacuum inside.

In the present embodiment, the front substrate 11 and the sidewall 13 are bonded to each other by electrically conductive sealing members 21*a* and 21*b*, which will be mentioned later, while the rear substrate 12 and the sidewall 13 are bonded to each other by a low-melting sealing member 40 such as frit glass.

A plurality of plate-like spacers 14 are provided in the vacuum envelope 10 in order to support atmospheric pressure that acts on the front substrate 11 and the rear substrate 12. These spacers 14 are arranged parallel to the long sides of the vacuum envelope 10 and at given spaces in the direction parallel to the short sides. The spacers 14 are not specially limited to this shape. For example, columnar spacers or the like may be used instead.

Figure 4:
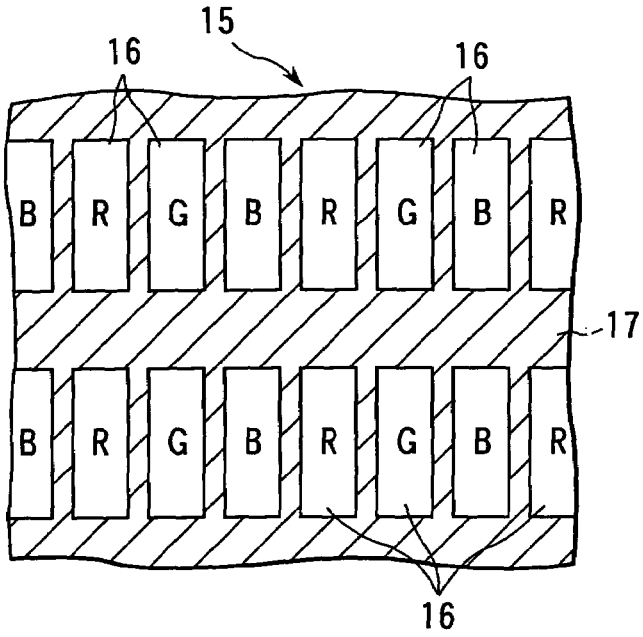
FIG. 4 is an enlarged view showing a part of a phosphor screen of the FED.

A phosphor screen 15, which has red, green, and blue phosphor layers 16 and a matrix-shaped black light absorbing layer 17, as shown in FIG. 4, is formed on the inner surface of the front substrate 11. An aluminum film (not shown) for use as a metal back is formed on the phosphor screen by vapor deposition.

As shown in FIG. 3, a number of electron emitting elements 18 for use as sources of electron emission for exciting the phosphor layers 16 are provided on the inner surface of the rear substrate 12. The electron emitting elements 18 are arranged in positions opposite to the phosphor layers 16, individually, and emit electron beams toward their corresponding phosphor layers.

The following is a description of a method of manufacturing the FED constructed in this manner.

Figure 5:
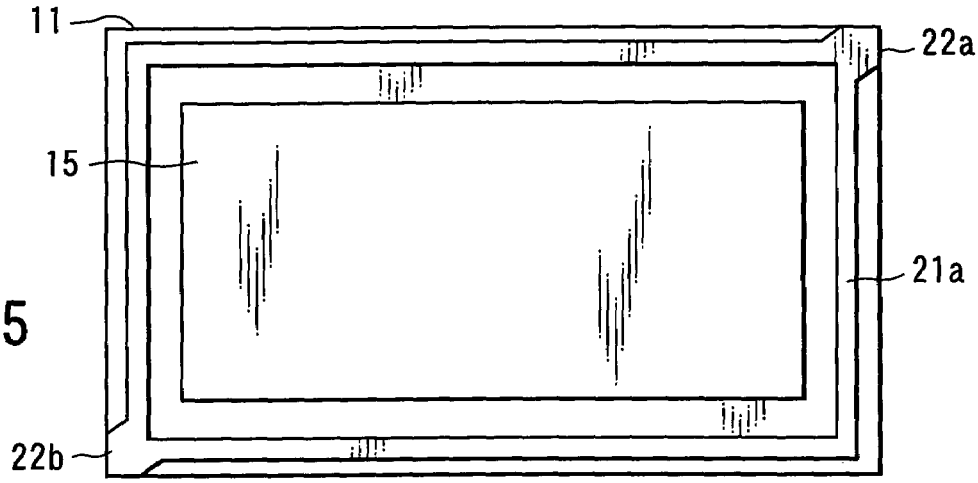
FIG. 5 is a plan view showing a front substrate used in the manufacture of the FED.
Figure 6:
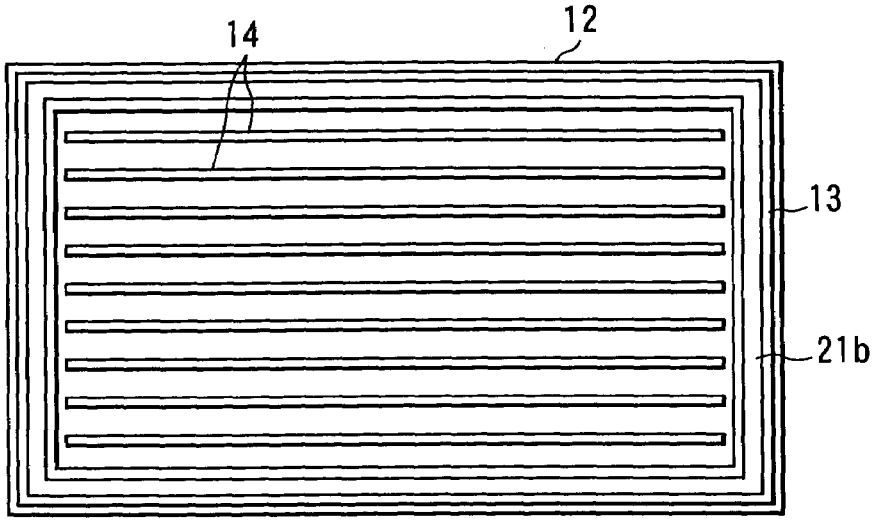
FIG. 6 is a plan view showing a rear substrate, sidewall, and spacers used in the manufacture of the FED.

In an unassembled state, as shown in FIGS. 5 and 6, the phosphor screen 15 and the metal back (not shown) are formed on the inner surface of the front substrate 11. Outside the phosphor screen 15 on the inner surface of the front substrate 11, a rectangular frame-shaped space is coated with electrically conductive metallic solder for use as the sealing member 21*a*, which is located along the peripheral edge of the front substrate 11. Electrode portions 22*a* and 22*b*, which serve to supply current to the sealing member 21*a* during sealing operation, project individually outward from two diagonal parts of the sealing member.

The respective cross sections of the electrode portions 22*a* and 22*b* are wider than those of any other parts of the sealing member 21.

A number of electron emitting elements 18 are previously formed on the inner surface of the rear substrate 12. In order to secure a gap between the rear substrate 12 and the front substrate 11 at the time of assembly, moreover, the sidewall 13 and the spacers 14 are mounted on the inner surface of the rear substrate 12 by means of the low-melting sealing member 40. On the sidewall 13, furthermore, a rectangular frame-shaped space that faces the sealing member 21*a* on the side of the front substrate 11 is filled with electrically conductive metallic solder.

Figure 7:
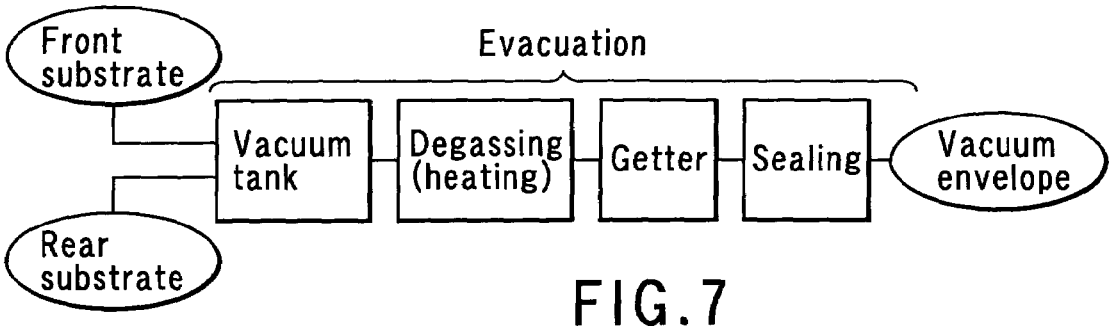
FIG. 7 is a flowchart showing the flow of assembly in a vacuum tank in manufacturing processes for the FED.

The front substrate 11 and the rear substrate 12 described above are assembled in a vacuum tank in accordance with processes shown in FIG. 7. More specifically, the front substrate 11 and the rear substrate 12 are first introduced into the vacuum tank, and the vacuum layer is evacuated. Thereafter, the front substrate 11 and the rear substrate 12 are heated and fully degassed. The heating temperature is fitly set to about 200° C. to 500° C. This is done in order to reduce the rate of gas discharge from the inner wall, which lowers the degree of vacuum after the vacuum envelope is formed, thereby preventing lowering of properties that is attributable to residual gas.

Then, a getter film is formed on the phosphor screen 15 of the front substrate 11 having been fully degassed and cooled. This is done in order to adsorb and discharge the residual gas by means of the getter film after the vacuum envelope is formed, thereby keeping the degree of vacuum in the vacuum envelope at a satisfactory level.

Subsequently, the front substrate 11 and the rear substrate 12 are put on each other in a predetermined position so that the phosphor layers 16 and the electron emitting elements 18 face one another. In this state, the sealing members 21*a* and 21*b* are supplied with current from the electrode portions 22*a* and 22*b*, whereupon these sealing members are heated and melted. Thereafter, the current supply is stopped, and heat from the sealing members 21*a* and 21*b* is quickly diffusively conducted to the front substrate 11 and the sidewall 13, and the sealing members 21*a* and 21*b* are solidified. In consequence, the front substrate 11 and the sidewall 13 are sealed to each other by means of the sealing members 21*a* and 21*b*.

The following is a description of a manufacturing apparatus used in the sealing process described above individual components of the FED.

Figure 8:
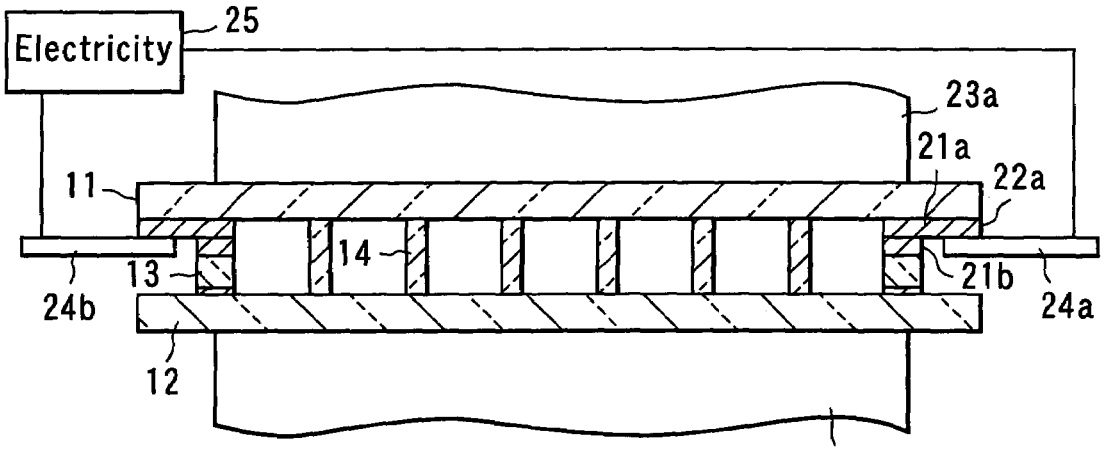
FIG. 8 is a sectional view showing a process of sealing the front substrate and the sidewall, among the FED manufacturing processes.

In an unsealed state, as shown in FIG. 8, the temperature of the front substrate 11 and the rear substrate 12 is set so that it is lower than the melting point of the sealing members 21*a* and 21*b*, and the sealing members 21*a* and 21*b* are solid. In this state, the front substrate 11 and the rear substrate 12 are lapped in the predetermined position, and the sealing members 21*a* and 21*b* are also lapped on each other. A given sealing load is applied to the front substrate 11 and the rear substrate 12 by means of pressurizing devices 23*a* and 23*b* in a direction such that they approach each other. Further, an image display region is held in a given gap by the spacers 14, and the sealing members 21*a* and 21*b* are in contact with each other. Furthermore, feeding terminals 24*a* and 24*b* are in contact with the electrode portions 22*a* and 22*b* of the sealing member 21*a*, respectively, and the feeding terminals 24*a* and 24*b* are connected to a power source 25.

If a given current is supplied to the sealing members 21*a* and 21*b* through the feeding terminals 24*a* and 24*b* in this state, only the sealing members 21*a* and 21*b* are heated and melted. If the current supply is stopped, thereafter, heat from the sealing members 21*a* and 21*b* that have a small heat capacity is discharged into the front substrate 11 and the sidewall 13 by a temperature gradient, whereupon thermal equilibrium with the front substrate 11 and the sidewall 13 is established. Thus, the sealing members are cooled and solidified rapidly.

According to this method, the vacuum envelope can be sealed in a vacuum by the simple manufacturing apparatus in a very short time. More specifically, with use of the electrically conductive sealing members, only the sealing members that have a small heat capacity or small volume can be selectively heated without heating the substrates. Thus, lowering of positional accuracy or the like that is attributable to thermal expansion of the substrates can be restrained.

Since the heat capacity of the sealing members is much smaller than the heat capacity of the substrates, moreover, the time required by heating and cooling can be made much shorter than in the case of the conventional method in which the whole substrates are heated. Thus, the mass-productivity can be improved considerably. Necessary devices for sealing includes only the mere feeding terminals and a mechanism for bringing them into contact with the sealing members. Thus, a clean apparatus can be realized that is much simpler and more suited for ultrahigh vacuum than the electromagnetic induction heating method, not to mention the conventional whole-surface heater.

The supplied current used is not limited to DC current, and may be AC current that fluctuates in the commercial frequency band. In this case, the apparatus can be simplified without the trouble of converting commercial current transmitted in the form of AC current into DC current. Further, AC current that fluctuates in the high frequency band of the kHz level may be used instead. In this case, Joule heat increase as the effective resistance for high frequency is increased by the skin effect. Therefore, the same heating effect as aforesaid can be obtained with use of a smaller current value.

According to the embodiment, moreover, the current-supply time ranges from about 5 to 300 seconds. If the current-supply time is long (or if power is low), the temperature around the substrates rises to lower the cooling speed, or thermal expansion produces an ill effect. If the current-supply time is short (or if power is high), uneven charging of electrically conductive sealing material causes disconnection or the glass thermal stress causes cracking of the substrates. Accordingly, the supply power and time (including change of power with time) should be adjusted to optimum conditions for each object.

According to the embodiment, the temperature difference between the substrate temperature and the melting point of the sealing members during the sealing operation is adjusted to about 20° C. to 150° C. If the temperature difference is great, the glass thermal stress increases, though the cooling time can be shortened. Accordingly, the temperature difference should be also adjusted to optimum conditions for each object.

Figure 9:
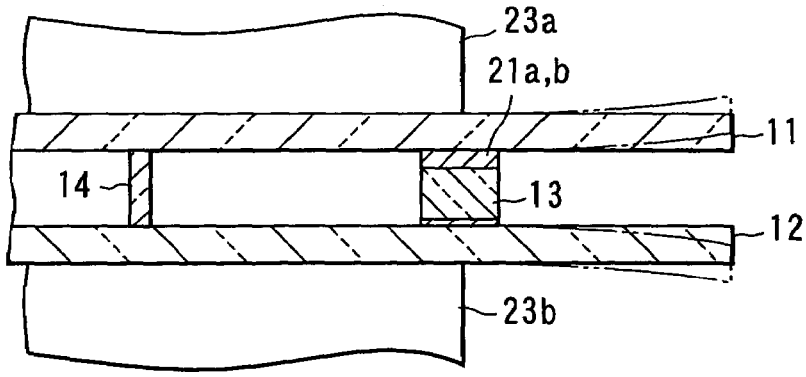
FIG. 9 is a view illustrating a method of lightening glass stress that is generated as the FED according to the embodiment of the present invention is sealed.
Figure 10A:
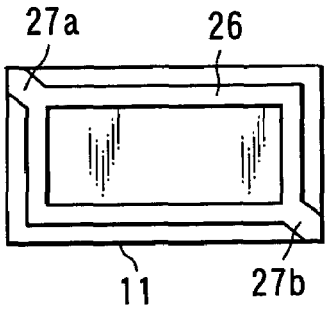
FIGS. 10A to 10C are plan views individually showing components of an FED according to a second embodiment of the present invention.
Figure 10B:
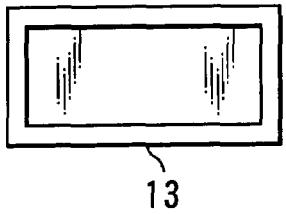
Figure 10C:
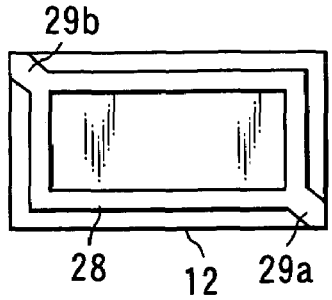
Figure 11:
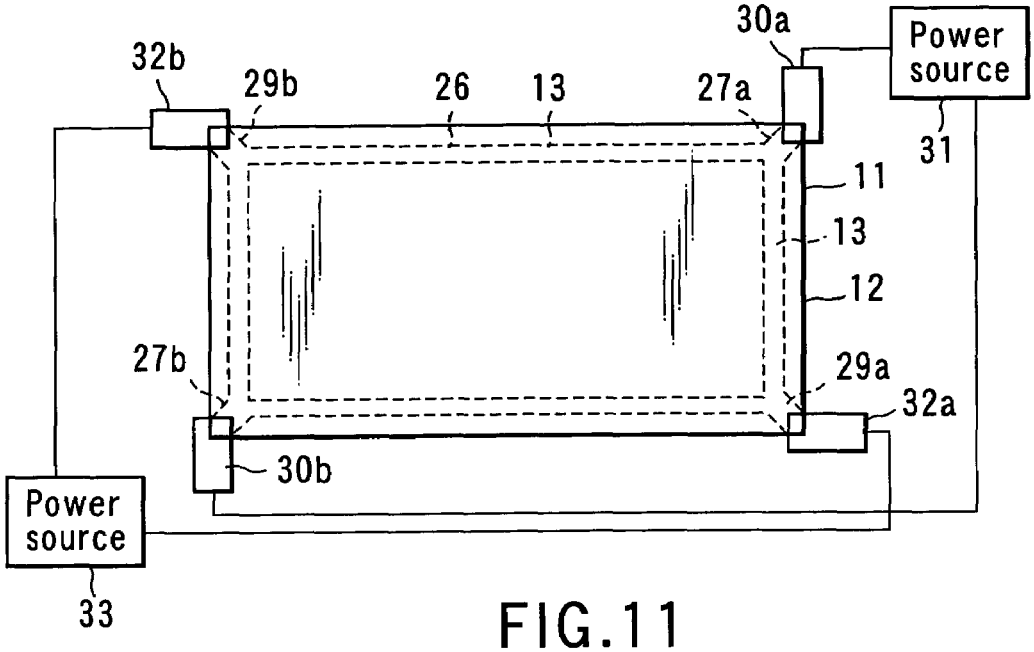
FIG. 11 is a plan view showing a sealing process for the FED of the second embodiment.

Further, stress and distortion produced by the difference in temperature between the obverse and reverse surfaces of the substrates that is attributable to the diffusive conduction of heat from the sealing members can be reduced by making the outside diameter of the pressurizing devices 23*a* and 23*b* a size smaller than that of the substrates so that the peripheries of the substrates can bend naturally, as indicated by broken lines in FIG. 9. Alternatively, the same stress lightening effect can be obtained by providing the respective peripheral parts of the pressurizing devices 23*a* and 23*b* with shaved portions as relieves for the warp of the substrates even if the outside diameter of the pressurizing devices is not reduced.

In the embodiment described above, moreover, the vacuum envelope used is designed so that the sidewall is sandwiched between the front substrate and the rear substrate. Alternatively, however, the sidewall may be formed integrally with the front substrate or the rear substrate. Further, the sidewall may be bonded to the front substrate and the rear substrate so as to cover them laterally. Furthermore, sealed surfaces that are sealed by current-supply heating of the sealing members may be two surfaces between the front substrate and the sidewall and between the rear substrate and the sidewall.

According to the first embodiment described above, current-supply heating is carried out with the sealing member on the front substrate side and the sealing member on the rear substrate side in contact with each other. Alternatively, however, the substrates may be bended before the sealing members are solidified after they are subjected to current-supply heating in a non-contact state. The respective configurations of the phosphor screen and the electron emitting elements are not limited to the embodiment of the present invention, and may be any other configurations. Further, only one of the two sealed surfaces may be loaded with the sealing members.

In order to ensure the wettability and the like of the electrically conductive sealing members on the substrates, ground layers may be formed between the sealing members and the substrates or between the sealing members and the sidewall.

The following is a description of a plurality of examples.

EXAMPLE 1

The following is a description of an example in which the front substrate 11 and the rear substrate 12 shown in FIGS. 5 and 6 are applied to an FED display apparatus for 36-inch TV. This example shares the principal configuration with the foregoing embodiment.

The front substrate 11 and the rear substrate 12 are formed of a glass material of 2.8-mm thickness each, while the sidewall 13 is formed of a glass material of 1.1-mm thickness. The sealing members 21*a* and 21*b* on the sidewall 13 of the front substrate 11 and the rear substrate 12 were formed of In (indium) that melts at about 156° C., and were loaded to the width of 3 to 5 mm and thickness of 0.1 to 0.3 mm. The electrode portions 22*a* and 22*b* were located in two symmetrical positions in diagonal parts such that X-wiring and Y-wiring on the opposite rear substrate 12 interfered little with each other. In order to lessen the risk of disconnection during current supply, moreover, the electrode portions 22*a* and 22*b* are formed having the width of about 16 mm and thickness of 0.1 to 0.3 mm so that their cross section is wider than those of any other portions. The resistance of the sealing member 21*a* between the electrode portions 22*a* and 22*b* is about 0.1 to 0.5 Ω at room temperature.

After degassing in the vacuum tank and getter film formation are carried out, the front substrate 11 and the rear substrate 12 are set in the pressurizing devices 23*a* and 23*b*. Then, as shown in FIG. 8, the front substrate 11 and the rear substrate 12 are located in a predetermined position at the temperature of about 100° C., and are lapped on each other under the load of about 50 kg by means of the pressurizing devices 23*a* and 23*b*. At the same time, the feeding terminals 24*a* and 24*b* are connected to the electrode portions 22*a* and 22*b*, respectively.

In this state, DC current of 120 A is applied to the feeding terminals 24*a* and 24*b* for 100 seconds, and the sealing members 21*a* and 21*b* are fully melted throughout the circumference. After the current supply was stopped, the front substrate 1 and the rear substrate 12 were held for 60 seconds, and heat from the sealing members 21*a* and 21*b* that had been heated up by current-supply heating was discharged into the front substrate 11 and the sidewall 13, whereupon the sealing members 21*a* and 21*b* were solidified.

When a vacuum envelope was manufactured in this manner, the sealing time, which had conventionally been about 30 minutes, was considerably shortened to several minutes, and the apparatus for sealing was able to be simplified.

EXAMPLE 2

Example 2 shares the principal configuration with Example 1.

In the aforesaid sealing process in Example 2, sine-wave AC current having an effective current value of 150 A that varies at 60 Hz, commercial frequency, was applied to the sealing members 21*a* and 21*b* for 40 seconds. Thereafter, the sealing members were held for 30 seconds, whereupon a vacuum envelope was formed.

EXAMPLE 3

Example 3 shares the principal configuration with Example 1.

In the sealing process in Example 3, sine-wave AC current having an effective current value of 4 A that varies at, for example, 300 kHz, which is higher than the commercial frequency, was applied to the sealing members 21*a* and 21*b* for 40 seconds. Thereafter, the sealing members were held for 30 seconds, whereupon a vacuum envelope was formed.

FIGS. 10A to 10C and FIG. 11 show a second embodiment of this invention. According to the second embodiment, a rear substrate 12 and a sidewall 13, as well as a front substrate 11 and the sidewall 13, are bonded together in the vacuum tank with use of electrically conductive sealing members. The second embodiment shares the principal configuration with the first embodiment.

In this case, that part of the front substrate 11 which faces the sidewall 13 is loaded with a sealing member 26 in the form of a rectangular frame, and electrode portions 27*a* and 27*b* are arranged projecting individually outward from two diagonal corner portions of the sealing member 26. Further, that part of the rear substrate 12 which faces the sidewall 13 is loaded with a sealing member 28 in the form of a rectangular frame, and electrode portions 29*a* and 29*b* are arranged projecting individually outward from two diagonal corner portions of the sealing member 28.

The front substrate 11, rear substrate 12, and sidewall 13 are lapped on one another in the aforesaid predetermined position, and 100 A is supplied from a power source 31 to the electrode portions 27*a* and 27*b* through feeding terminals 30*a* and 30*b* for 150 seconds. At the same time, 100 A is supplied from a power source 33 to the electrode portions 29*a* and 29*b* through feeding terminals 32*a* and 32*b* for 150 seconds. Thereafter, the sealing members 26 and 28 are held for about 2 minutes and solidified, whereby the front substrate 11, rear substrate 12, and sidewall 13 are sealed together.

In the first and second embodiments, the paired electrode portions on the sealing member should only be located in symmetrical positions, and need not always be attached to a pair of diagonal parts of the sealing member. Thus, they may be provided to the long or short side portions. The material of the electrically conductive sealing members is not to In, and may alternatively be an alloy that contains In.

The following is a description of an FED according to a third embodiment of this invention and a method of manufacturing the same and a apparatus for manufacturing the apparatus.

Figure 12:
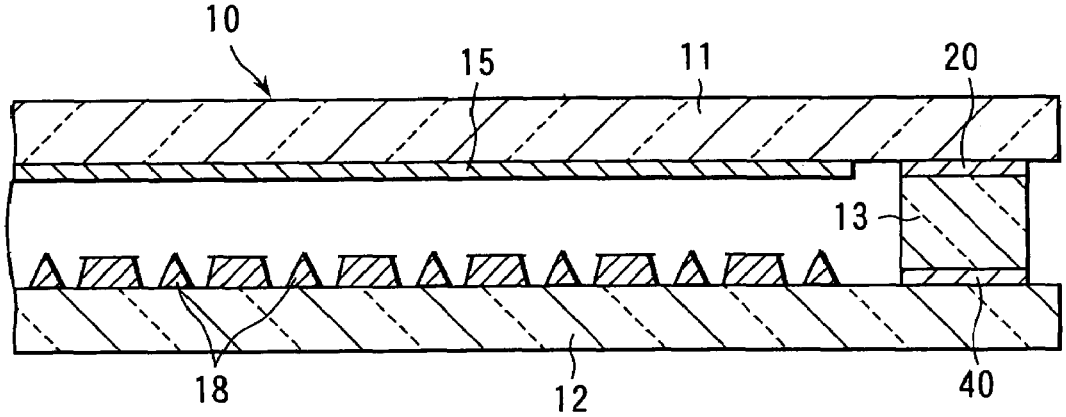
FIG. 12 is a sectional view showing an FED according to a third embodiment of this invention.

As shown in FIG. 12, the FED according to the present embodiment comprises a front substrate 11 and a rear substrate 12, which are formed of a rectangular glass material each. These substrates are opposed to each other with a gap of 1 to 2 mm between them. The front substrate 11 and the rear substrate 12 have their respective peripheral edge portions bonded together by means of a sidewall 13 in the form of a rectangular frame, and constitute a flat, rectangular vacuum envelope 10 that is kept vacuum inside. The front substrate 11 and the sidewall 13 are joined to each other through a sealing member, which will be mentioned later, while the rear substrate 12 and the sidewall 13 are bonded to each other by means of a low-melting sealing member 40 such as frit glass. The present embodiment shares other configurations with the first embodiment. Like reference numerals are used to designate like portions, and a detailed description of those portions is omitted.

The following is a description of the manufacturing method and the manufacturing apparatus for the FED constructed in this manner.

Figure 13:
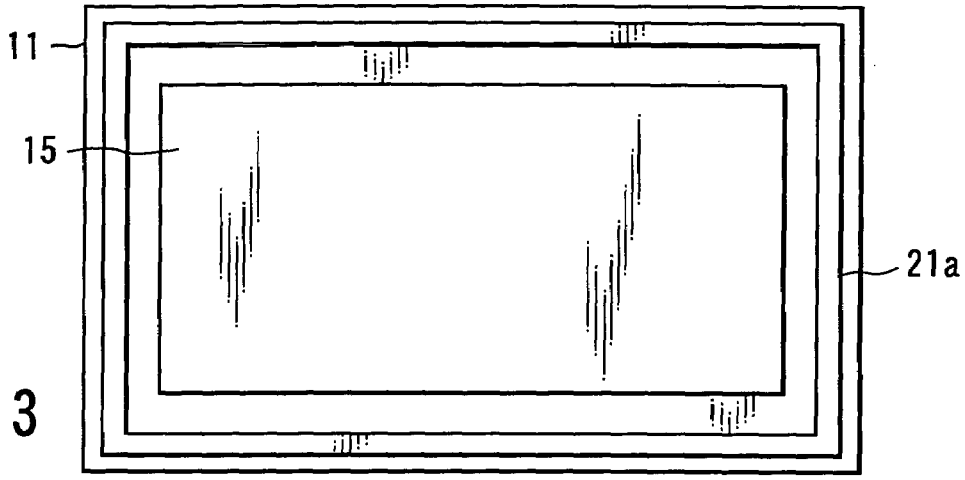
FIG. 13 is a plan view of a front substrate of the FED shown in FIG. 12 taken from the inside.

In an unassembled state, as shown in FIG. 13, a phosphor screen 15 is formed on the inner surface of the front substrate 11. On the inner surface of the front substrate 11, moreover, the outer peripheral edge portion of the phosphor screen 15 is provided with electrically conductive metallic solder for use as a sealing material 21*a* in the shape of a rectangular frame. At this point of time, the temperature of the front substrate 11 is set to a temperature lower than the melting point of the sealing material 21*a*, and the sealing material 21*a* is in a solid state.

Figure 14:
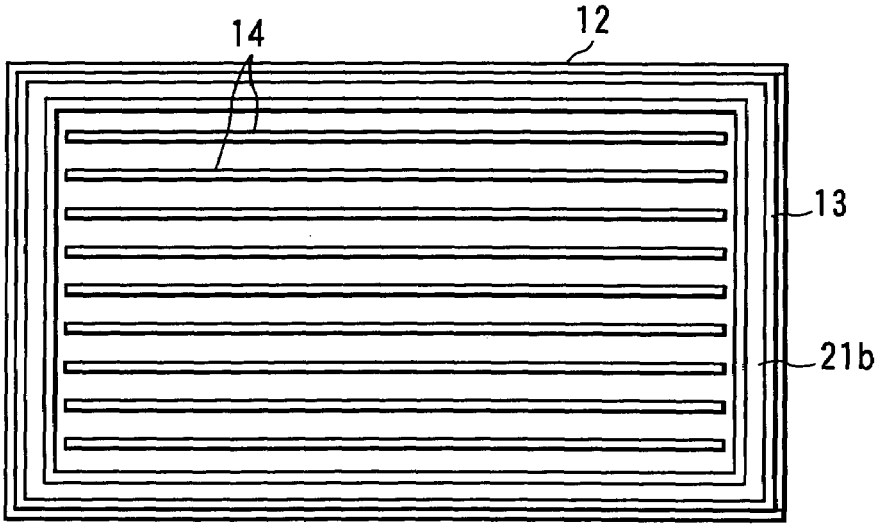
FIG. 14 is a plan view showing a rear substrate, sidewall, and spacers of the FED shown in FIG. 12.

In an unassembled state, as shown in FIG. 14, a number of electron emitting elements 18 (not shown in this case) are previously formed on the inner surface of the rear substrate 12. In order to secure a gap between the rear substrate 12 and the front substrate 11 at the time of assembly, moreover, the sidewall 13 and spacers 14 are fixed to the inner surface of the rear substrate 12 by the low-melting sealing member 40. On the sidewall 13, metallic solder having the same electrical conductivity with the aforesaid sealing material 21*a* is provided as a sealing material 21*b* in the form of a rectangular frame in a position that faces the sealing material 21*a* on the side of the front substrate 11. At this point of time, the temperature of the rear substrate 12 is set to a temperature lower than the melting point of the sealing material 21*b*, and the sealing material 21*b* is in a solid state.

A material that melts or softens at the temperature of 300° C. or less is selected for the sealing materials 21*a* and 21*b*. In the present embodiment, however, In or an alloy that contains In is used for the sealing materials 21*a* and 21*b*.

Figure 15A:
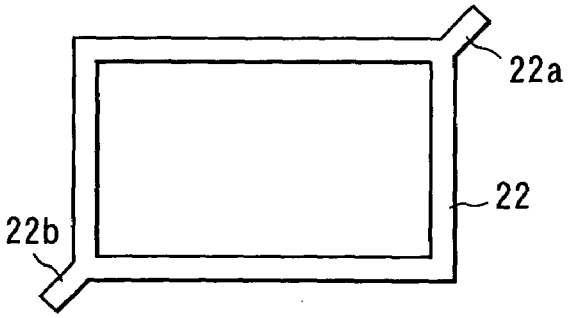
FIGS. 15A and 15B are plan views individually showing conductive members used in the manufacture of the FED shown in FIG. 12.

FIG. 15A shows a conductive member 22 in the form of a frame that is sandwiched between the sealing materials 21*a* and 21*b* when the peripheral edge portion of the front substrate 11 and the upper end of the sidewall 13 are sealed together. The conductive member 22, along with the aforesaid sealing materials 21*a* and 21*b*, functions as a sealed portion 20.

The conductive member 22 is formed of a nickel alloy plate having a cross section of 0.1 $mm^2$ or more, and two electrode portions 22*a* and 22*b* (connecting terminals) protrude integrally from its diagonal corner portions. The conductive member 22 is narrower than each of the sealing materials 21*a* and 21*b*. An alloy that contains iron (Fe), chromium (Cr), or aluminum (Al), instead of nickel (Ni), may be used for the conductive member 22. The material used has a melting point of 500° C. or more.

The coefficient of thermal expansion of the conductive member 22 is set to about 80 to 120% of the coefficient of thermal expansion of the sealing materials 21*a* and 21*b* or about 80 to 120% of the coefficient of thermal expansion of the sidewall 13. Alternatively, it is set to a value intermediate between the lowest and the highest of the respective coefficients of thermal expansion of the front substrate 11, rear substrate 12, and sidewall 13.

The front substrate 11 and the rear substrate 12 constructed in this manner are sealed together in the vacuum tank with the conductive member 22 between them, thereby forming the FED.

First, the front substrate 11, rear substrate 12, and conductive member 22 are introduced into the vacuum tank, and the vacuum layer is evacuated substantially in the same manner as in the sealing process shown in FIG. 7. Thereafter, the front substrate 11 and the rear substrate 12 are heated and fully degassed. The heating temperature is fitly set to about 200° C. to 500° C. This is done in order to reduce the rate of gas discharge from the inner wall, which lowers the degree of vacuum after the vacuum envelope is formed, thereby preventing lowering of properties that is attributable to residual gas.

Then, a getter film is formed on the phosphor screen 15 of the front substrate 11 that is fully degassed and cooled. This is done in order to adsorb and discharge the residual gas by means of the getter film after the vacuum envelope is formed, thereby keeping the degree of vacuum in the vacuum envelope at a satisfactory level.

The front substrate 11 and the rear substrate 12 are positioned with high accuracy and lapped on each other so that phosphor layers 16 and electron emitting elements 18 face one another. As this is done, the conductive member 22 is sandwiched between the sealing material 21*a* on the peripheral edge portion of the front substrate 11 and the sealing material 21*b* on the sidewall 13.

Figure 16:
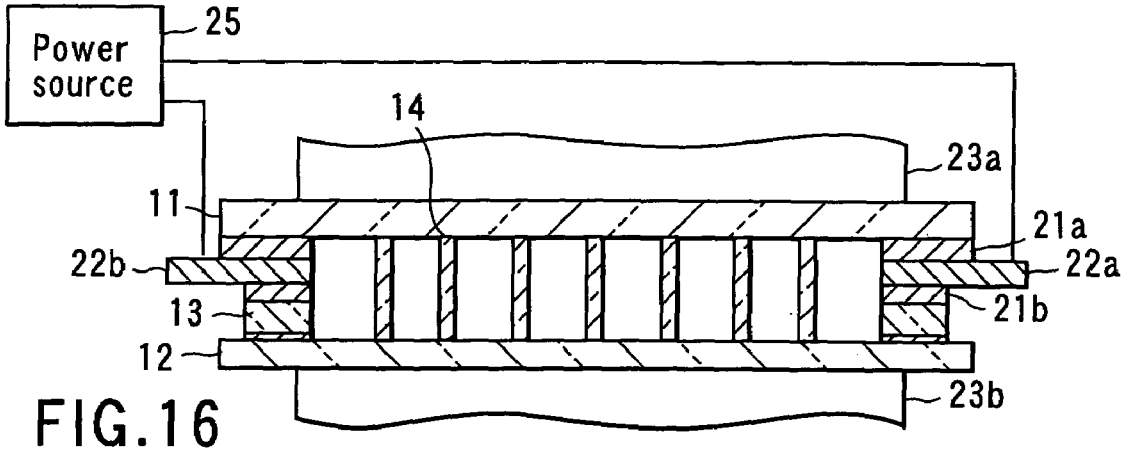
FIG. 16 is a view schematically showing a manufacturing apparatus for manufacturing the FED of FIG. 12.

The front substrate 11 and the rear substrate 12 between which the conductive member 22 is sandwiched in this manner are set in the apparatus shown in FIG. 16. Then, the front substrate 11 and the rear substrate 12 are pressed toward the each other under a given pressure and held by means of the pressurizing devices 23*a* and 23*b*. Further, the power source 25 is connected to the electrode portions 22*a* and 22*b* that are led out from the conductive member 22.

In this state, a given current is supplied from the power source 25 to the conductive member 22 through the electrode portions 22*a* and 22*b*, thereby energizing the sealing materials 21*a* and 21*b*. Thereupon, the conductive member 22 and the sealing materials 21*a* and 21*b* are heated, and only the sealing materials 21*a* and 21*b* melt. More specifically, the conductive member 22 is formed of a high-melting material that cannot be melted by current supply, so that only the sealing materials 21*a* and 21*b* melt. The melted sealing materials 21*a* and 21*b* are joined so as to envelope the narrow conductive member 22. If the current supply is stopped, thereafter, heat from the joined sealing materials 21 that have a relatively small heat capacity is quickly diffusively conducted to the front substrate 11 and the sidewall 13 by a temperature gradient, whereupon thermal equilibrium with the front substrate 11 and the sidewall 13, which have a large heat capacity, is established. Thus, the sealing materials 21 are cooled and solidified rapidly. Thereupon, the front substrate 11 and the sidewall 13 are sealed together.

According to the third embodiment, as described above, only the sealing materials 21*a* and 21*b* can be heated and melted selectively and securely with high efficiency with use of a very simple arrangement such that the conductive member 22 is only supplied with current. Thus, necessary stages of operation, processing time, and power consumption for the sealing process can be cut considerably, and the respective peripheral edge portions of the front substrate 11 and the rear substrate 12 can be sealed securely and easily together.

Thus, according to the present embodiment, the electrically conductive sealing materials 21*a* and 21*b* and the conductive member 22 are used in combination. If the sealing materials are arranged unevenly, therefore, current can be securely supplied to all the regions of the sealing materials 21*a* and 21*b* without the possibility of the sealing materials breaking, and the sealing materials can be securely melted throughout the length. Since the sealing materials 21*a* and 21*b* are electrically conductive, moreover, the sealing materials 21*a* and 21*b*, compared with nonconductive sealing materials, can be heated directly, so that the melting time can be shortened.

According to the present embodiment, furthermore, the conductive member 22 is sandwiched between the sealing materials 21*a* and 21*b*. Therefore, the conductive member 22 never touches the front substrate 11 and the sidewall 13, so that there is no possibility of the front substrate 11 and the sidewall 13 being broken by thermal stress. Since the conductive member 22 is not in contact with the front substrate 11 and the sidewall 13, moreover, the area of contact between the conductive member 22 and the front substrate 11 and the sidewall 13 can be increased, so that the sealing performance can be enhanced.

According to the present embodiment, moreover, only the sealing materials can be selectively heated and melted. Therefore, the front substrate and the rear substrate need not be heated, and only the sealing materials that have a small heat capacity or small volume should be heated. Thus, the power consumption can be reduced, and lowering of positional accuracy or the like that is attributable to thermal expansion or thermal contraction of the substrates can be restrained.

According to this method, the time required by heating and cooling can be made much shorter than in the case of the conventional method in which the whole substrates are heated, so that the mass-productivity can be improved considerably. Further, only the power source is required as a device for sealing. Thus, a clean apparatus can be realized that is much simpler and more suited for ultrahigh vacuum than the electromagnetic induction heating method, not to mention the conventional whole-surface heater.

The supplied current used is not limited to DC current, and may be AC current that fluctuates in the commercial frequency band. In this case, the apparatus can be simplified without the trouble of expressly converting commercial current transmitted in the form of AC current into DC current. Further, AC current that fluctuates in the high frequency band of the kHz level may be used instead. In this case, Joule heat increases as the effective resistance for high frequency is increased by the skin effect. Therefore, the same heating effect as aforesaid can be obtained with use of a smaller current value.

According to the embodiment, moreover, the current-supply time ranges from about 5 to 30 seconds. If the current-supply time is long (or if power is low), the temperature around the substrates rises to lower the cooling speed, or thermal expansion or thermal contraction produces an ill effect. If the current-supply time is short (or if power is high), uneven charging of electrically conductive sealing material causes disconnection or the glass thermal stress causes cracking. Accordingly, the supply power and time (including change of power with time) should be adjusted to optimum conditions for each object.

According to the present embodiment, moreover, the temperature difference between the substrate temperature and the melting point of the sealing members during the sealing operation is adjusted to about 20° C. to 150° C. If the temperature difference is great, the glass thermal stress increases, though the cooling time can be shortened. Accordingly, the temperature difference should be also adjusted to optimum conditions for each object.

Figure 15B:
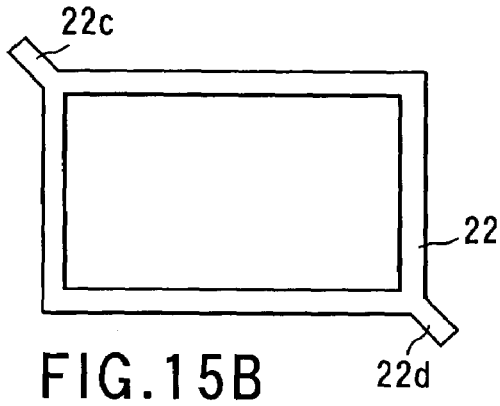
Figure 17:
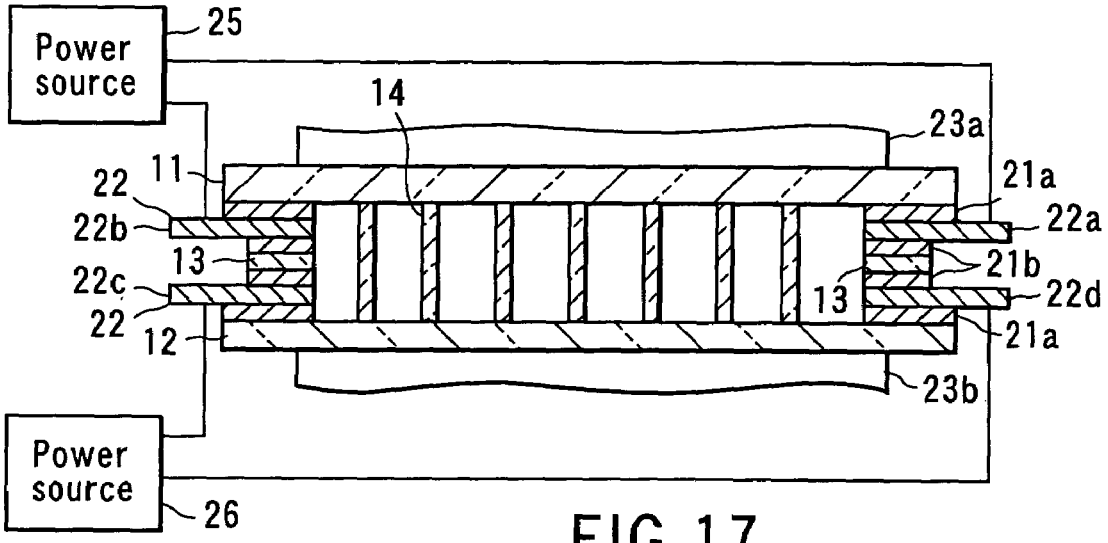
FIG. 17 is a view showing a modification of a manufacturing apparatus for sealing the front substrate, rear substrate, and sidewall together.

In the third embodiment, as shown in FIG. 17, two sealed portions between the front substrate 11 and the sidewall 13 and between the rear substrate 12 and the sidewall 13 may be sealed by current-supply heating of the sealing materials. In this case, as in the third embodiment, the sidewall 13 and the peripheral edge portion of the front substrate 11 are sealed by means of the sealed portion 20. Another sealed portion 20 is interposed between the sidewall 13 and the peripheral edge portion of the rear substrate 12. The sealed portion 20 between the sidewall 13 and the peripheral edge portion of the rear substrate 12 forms the sealing material 21*b* on the lower surface of the sidewall 13, the conductive member 22 shown in FIG. 15B, and the sealing material 21*a* on the peripheral edge portion of the rear substrate 12. A power source 27 is connected to two electrodes 22*c* and 22*d* of the conductive member 22. As current is supplied from the power source 25 and 26 to the conductive member 22 to overheat it, as in the third embodiment, thereafter, the front substrate 11, sidewall 13, and rear substrate 12 are sealed together.

Figure 18:
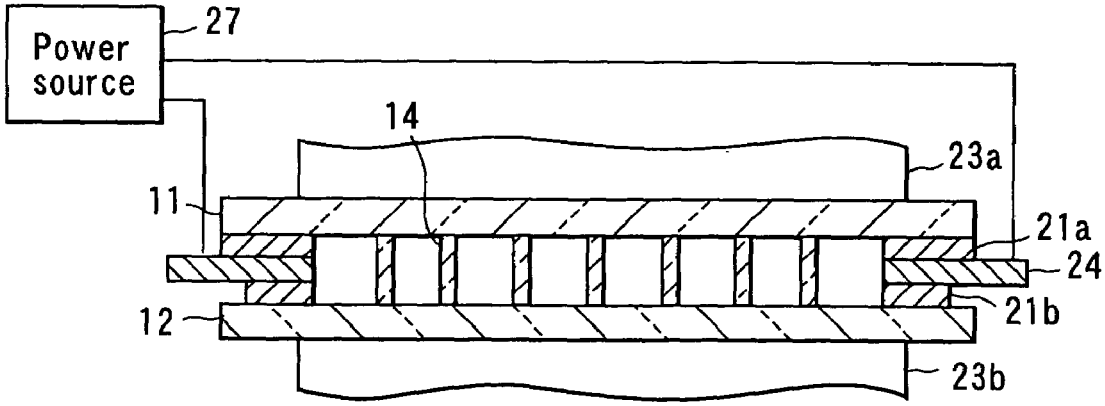
FIG. 18 is a view schematically showing another modification in which current is supplied to the electrically conductive sidewall for sealing.

As shown in FIG. 18, moreover, a sidewall 24 may be formed of an electrically conductive material, and a sealing material 21*a* may be provided between the sidewall 24 and the peripheral edge portion of the rear substrate 12. A sealing material 21*b* is provided between the sidewall 24 and the peripheral edge portion of the rear substrate 12, and current is supplied to the sidewall 24 itself. In this case, an independent conductive member 22 need not be provided as a conductive member. Thus, the manufacturing processes can be simplified, and the number of members can be reduced, so that the manufacturing cost can be lowered.

The surfaces of the conductive member 22 that are in contact with the sealing materials 21*a* and 21*b* may be rugged. As the sealing materials 21 are melted, in this case, mechanical deviations between the members as objects of sealing, that is, between the conductive member 22 and the front substrate 11, between the conductive member 22 and the rear substrate 12, and between the conductive member 22 and the sidewall 13 can be restrained. Thus, a positional deviation between the front substrate 11 and the rear substrate 12 can be restrained.

The following is a description of a plurality of examples to which the third embodiments are applied.

EXAMPLE 1

The following is a description of an example in which the front substrate 11 and the rear substrate 12 are applied to an FED display apparatus for 36-inch TV. This example shares the principal configuration with the foregoing embodiments.

The front substrate 11 and the rear substrate 12 are formed of a glass material of 2.8-mm thickness each, while the sidewall 13 is formed of a glass material of 1.1-mm thickness. The sealing material 21*a* on the peripheral edge portion of the front substrate 11 and the sealing material 21*b* on the sidewall 13 of the rear substrate 12 were made of In that melts at about 160° C., and were formed having the width of 3 to 5 mm and one-side thickness of 0.1 to 0.3 mm.

As shown in FIG. 15A, the conductive member 22 is formed of a nickel alloy frame of 1-mm width and 0.1-mm thickness. The electrode portions 22*a* and 22*b* of the conductive member 22 are located in two symmetrical positions in diagonal parts such that X-wiring and Y-wiring on the opposite rear substrate 12 interfere little with each other. In order to secure a satisfactory volume of current supply, the conductive member 22 has a cross section of 0.1 $mm^2$ or more. The resistance between the electrode portions 22*a* and 22*b* was set to about 0.05 to 0.5 Ω at room temperature.

The front substrate 11 and the rear substrate 12, along with the conductive member 22, are located in the vacuum tank and subjected to degassing in the vacuum tank and getter film formation. Thereafter, they are set in the pressurizing devices 23*a* and 23*b* with the conductive member 22 held between the peripheral edge portion of the front substrate 11 and the sidewall 13 on the rear substrate 12. Thus, the front substrate 11, rear substrate 12, and conductive member 22 are located in a predetermined position at the temperature of about 100° C., and are lapped on each other under the load of about 50 kg by means of the pressurizing devices 23*a* and 23*b*. Further, the power source 25 is connected to the electrode portions 22*a* and 22*b* of the conductive member 22.

In this state, DC current of 130 A is applied to the electrode portions 22*a* and 22*b* through the power source 25 for 40 seconds, thereby heating the conductive member 22, and the sealing members 21*a* and 21*b* are melted uniformly and fully throughout the circumference. After the current supply was stopped, the front substrate 1 and the rear substrate 12 were held for 30 seconds, and heat from the sealing members 21*a* and 21*b* that had been heated up by current-supply heating was discharged into the front substrate 11 and the sidewall 13, whereupon the sealing members 21*a* and 21*b* were cooled and solidified.

When a vacuum envelope was manufactured in this manner, the sealing time, which had conventionally been about 30 minutes, was considerably shortened to about one minute, and the apparatus for sealing was able to be simplified.

EXAMPLE 2

Example 2 shares the principal configuration with Example 1.

In the aforesaid sealing process in Example 2, sine-wave AC current having an effective current value of 120 A that varies at 60 Hz, commercial frequency, was applied to the electrode portions 22*a* and 22*b* of the conductive member 22 for 60 seconds. Thereafter, the electrode portions were held for one minute, whereupon a vacuum envelope was formed.

EXAMPLE 3

Example 3 shares the principal configuration with Example 1.

In the aforesaid sealing process in Example 3, sine-wave AC current having an effective current value of 4 A that varies at, for example, 300 kHz, which is higher than the commercial frequency, was applied to the electrode portions 22*a* and 22*b* of the conductive member 22 for 30 seconds. Thereafter, the electrode portions were held for one minute, whereupon a vacuum envelope was formed.

EXAMPLE 4

Example 4 shares the principal configuration with Example 1.

In Example 4, as shown in FIG. 17, the rear substrate 12 and the sidewall 13, as well as the front substrate 11 and the sidewall 13, were also joined together in the vacuum tank with use of the aforesaid conductive member. At the same time, the rectangular frame-shaped sealing material 21*a*, conductive member 22 shown in FIG. 15A, and rectangular frame-shaped sealing material 21*b* were arranged at the junction where the peripheral edge portion of the front substrate 11 and the sidewall 13 face each other. Further, the rectangular frame-shaped sealing material 21*a*, conductive member 22 shown in FIG. 15B, and rectangular frame-shaped sealing material 21*b* were arranged at the junction where the peripheral edge portion of the rear substrate 12 and the sidewall 13 face each other.

The front substrate 11, rear substrate 12, and sidewall 13 were lapped on one another in the aforesaid predetermined position, and 100 A was supplied to the electrode portions 22*a* and 22*b* through the power source 25 for 150 seconds. At the same time, 100 A was supplied to the electrodes 22*c* and 22*d* through the power source 27 for 150 seconds. Thereafter, the sealing members 21*a* and 21*b* were held for about 2 minutes and solidified, whereupon the front substrate 11, rear substrate 12, and sidewall 13 were sealed together.

EXAMPLE 5

Example 5 shares the principal configuration with Example 1.

In Example 5, as shown in FIG. 18, the front substrate 11 and the rear substrate 12 were joined together through the electrically conductive sidewall 24 without using the aforesaid conductive members 22, and current was supplied to the sidewall 24 itself, whereupon the front substrate 11 and the rear substrate 12 were sealed together. In doing this, a rectangular frame of SUS304 of 2-mm width and 1.1-mm height was used as the sidewall 24 and supplied with 200 A for 30 seconds. After 140 A was then supplied for 10 seconds, the front substrate 11 and the rear substrate 12 were held for about 2 minute, and the sealing materials 21*a* and 21*b* were cooled and solidified.

The following is a description of an FED according to a fourth embodiment of this invention and a manufacturing method and a manufacturing apparatus for the FED.

Figure 19:
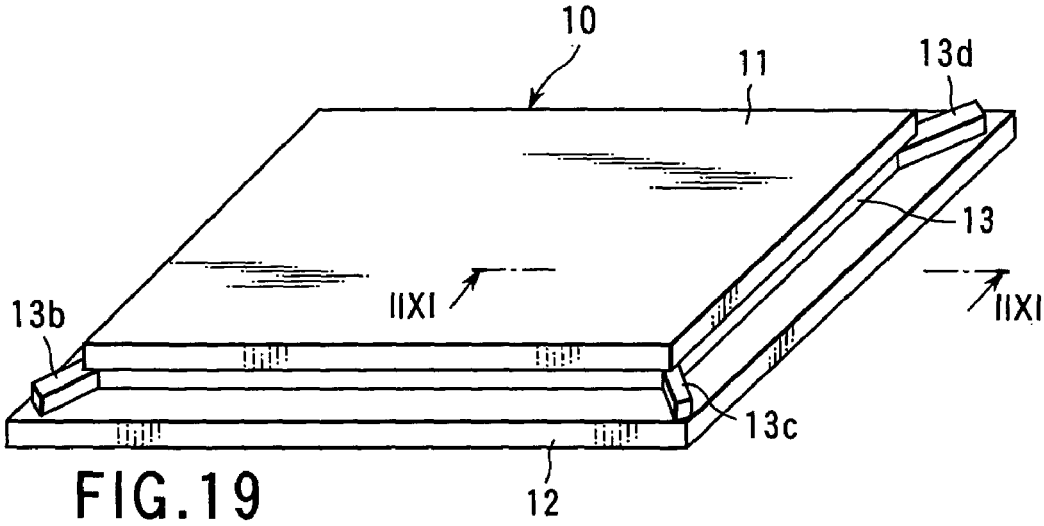
FIG. 19 is a perspective view showing an FED according to a fourth embodiment of this invention.
Figure 20:
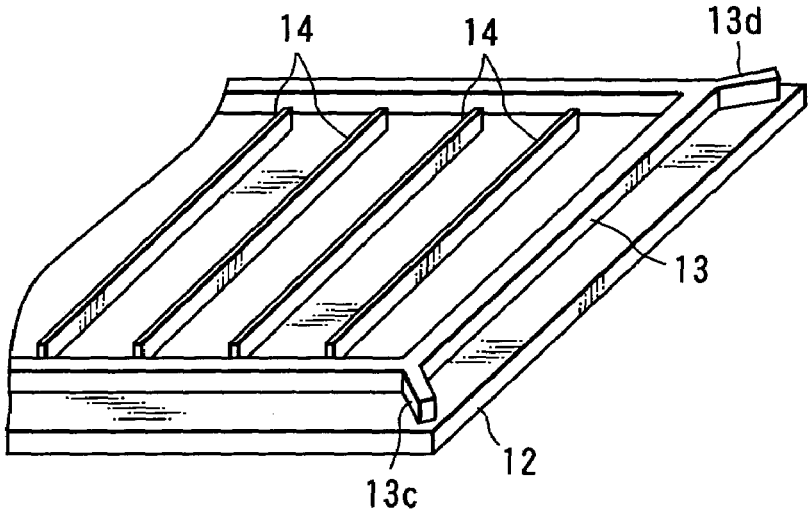
FIG. 20 is a perspective view showing the FED cleared of its front substrate.
Figure 21:
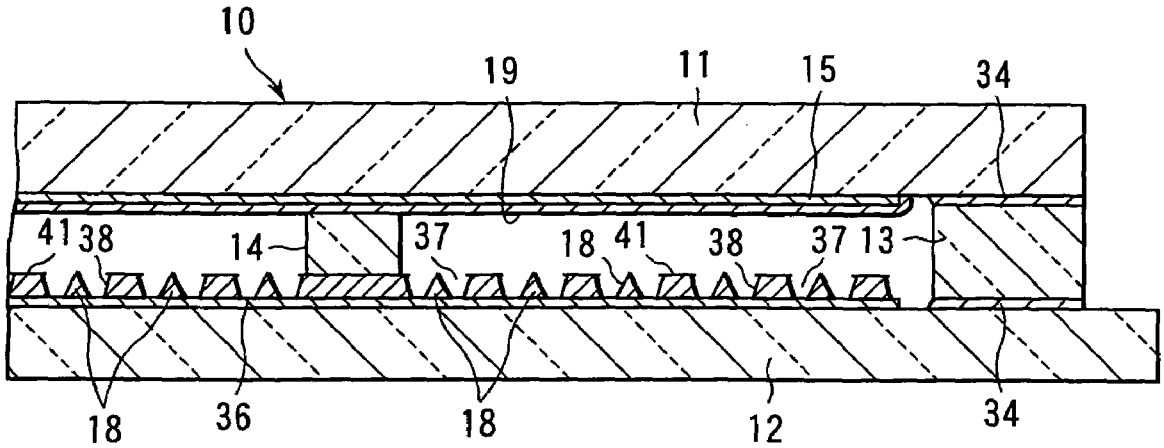
FIG. 21 is a sectional view taken along line IIXI—IIXI of FIG. 19.

As shown in FIGS. 19 to 21, this FED comprises a front substrate 11 and a rear substrate 12, which are formed of a rectangular glass material each. These substrates are opposed to each other with a gap of 1.6 mm between them. The rear substrate is a little greater in size than the front substrate, and lead wires (not shown) for inputting picture signals (mentioned later) are formed on its outer peripheral portion. The front substrate 11 and the rear substrate 12 have their respective peripheral edge portions bonded together by means of a sidewall 13 in the form of a substantially rectangular frame, and constitute a flat, rectangular vacuum envelope 10 that is kept vacuum inside.

Figure 22:
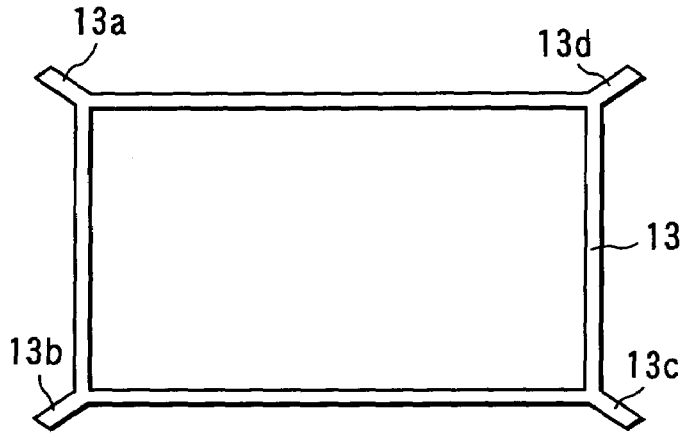
FIG. 22 is a plan view showing a sidewall of the FED shown in FIG. 19.

The sidewall 13 is formed of a high-melting conductive member that has electrical conductivity and a melting point higher than those of sealing materials (mentioned later). The material may be an iron-nickel alloy, for example. Alternatively, a material that contains at least one of Fe, Cr, Ni and Al may be used for the high-melting conductive member that has electrical conductivity. As shown in FIGS. 19, 20 and 22, the sidewall 13 has projections 13*a*, 13*b*, 13*c* and 13*d* that project individually outward in the diagonal directions from its corner portions. The sidewall 13 is sealed together with the rear substrate 12 and the front substrate 11 by means of In or In alloy for use as sealing materials 34, for example.

In a sealed state, the projections 13*a*, 13*b*, 13*c* and 13*d* of the sidewall 13 project outside the front substrate 11 and extend close to the corners of the rear substrate 12. As mentioned later, the projections 13*a*, 13*b*, 13*c* and 13*d* can function as connecting terminals for applying voltage to the sidewall 13 in the FED manufacturing processes and also as grip portions that are used in positioning the sidewall.

As shown in FIGS. 20 and 21, a plurality of plate-like spacers 14 are provided in the vacuum envelope 10 in order to support atmospheric load that acts on the front substrate 11 and the rear substrate 12. These spacers 14 are arranged parallel to the short sides of the vacuum envelope 10 and at given spaces in the direction parallel to the long sides. The spacers 14 are not specially limited to this shape. For example, columnar spacers or the like may be used instead.

Figure 23:
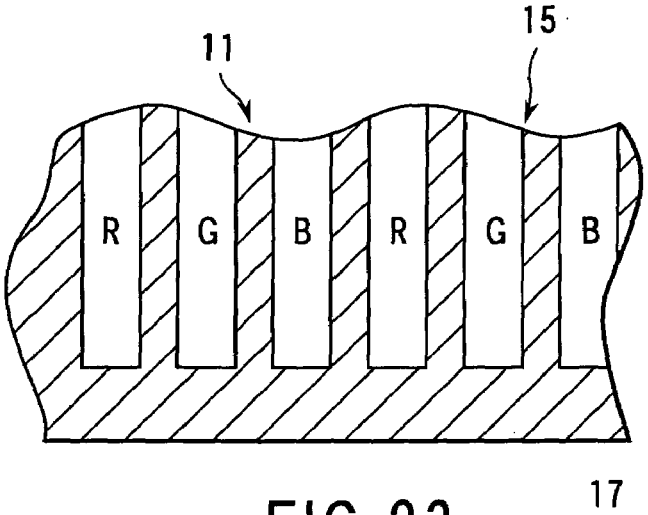
FIG. 23 is a plan view showing a phosphor screen of the FED shown in FIG. 19.

A phosphor screen 15 shown in FIG. 23 is formed on the inner surface of the front substrate 11. The phosphor screen 15 is formed of red, green, and blue stripe-shaped phosphor layers and a striped black light absorbing layer 17 as a non-luminous portion situated between the phosphor layers. The phosphor layers extend parallel to the short sides of the vacuum envelope, and are arranged at given spaces in the direction parallel to the long sides. A metal back layer 19 of, e.g., aluminum is formed on the phosphor screen 15 by vapor deposition.

A number of electron emitting elements 18 are provided on the inner surface of the rear substrate 12. They serve as sources of electron emission that excite the phosphor layers and individually emit electron beams. These electron emitting elements 18 are arranged in a plurality of columns and a plurality of rows corresponding to individual pixels. More specifically, a conductive cathode layer 36 is formed on the inner surface of the rear substrate 12, and a silicon dioxide film 38 having a number of cavities 37 is formed on the conductive cathode layer 36. Gate electrodes 41 of molybdenum or niobium are formed on the silicon dioxide film 38. On the inner surface of the rear substrate 12, moreover, conic electron emitting elements 18 of molybdenum or the like are provided in the cavities 37, individually.

In the FED constructed in this manner, the picture signals are applied to the electron emitting elements 18 and the gate electrodes 41 in the form of a simple matrix. Gate voltage of +100 V is applied to the electron emitting elements 18 as a reference when the luminance has its highest value. Further, +10 kV is applied to the phosphor screen 15. Thereupon, electron beams are emitted from the electron emitting elements 18. The size of the electron beams emitted from the electron emitting elements 18 is modulated by means of voltage from the gate electrodes 41, and the electron beams excite the phosphor layers of the phosphor screen 15 to luminescence, thereby displaying an image.

The following is a detailed description of the manufacturing method for the FED constructed in this manner.

First, the electron emitting elements are formed on plate glass for the rear substrate. In this case, the matrix-shaped conductive cathode layer 36 is formed on the plate glass, and the insulating film 38 of silicon dioxide is formed on the conductive cathode layer by the thermal oxidation method, CVD method, or sputtering method.

Thereafter, a metallic film of molybdenum or niobium for gate electrode formation is formed on the insulating film 38 by the sputtering method or electron-beam vapor deposition method, for example. Then, a resist pattern having a shape corresponding to the gate electrodes to be formed is formed on the metallic film by lithography. The metallic film is etched by the wet etching method or dry etching method with use of this resist pattern as a mask, whereupon the gate electrodes 41 are formed.

Then, the insulating film 38 is etched by the wet or dry etching method with use of the resist pattern and the gate electrodes 41 as masks, whereupon the cavities 37 are formed. After the resist pattern is then removed, a separation layer of, e.g., aluminum or nickel is formed on the gate electrodes 41 by electron-beam vapor deposition in a direction inclined at a given angle to the surface of the rear substrate 12. Thereafter, molybdenum as a material for cathode formation is deposited by the electron-beam vapor deposition method in a direction perpendicular to the surface of the rear substrate 12. Thereupon, the electron emitting elements 18 are formed in the cavities 37, individually. Subsequently, the separation layer, along with the metallic film thereon, is removed by the liftoff method.

Subsequently, the plate-like support members 14 are sealed on the rear substrate 12 by means of low-melting glass.

On the other hand, the phosphor screen 15 is formed on plate glass that is supposed to form the front substrate 11. In doing this, the plate glass that is as large as the front substrate 11 is prepared, and the stripe pattern of the phosphor layers is formed on the plate glass by means of a plotter machine. The plate glass having the phosphor strip pattern thereon and the plate glass for the front substrate are placed on a positioning jig and set on an exposure stage. Thereupon, they are exposed and developed to form the phosphor screen 15. Then, the metal back layer 19, an aluminum film, is formed overlapping the phosphor screen 15.

Figure 24:
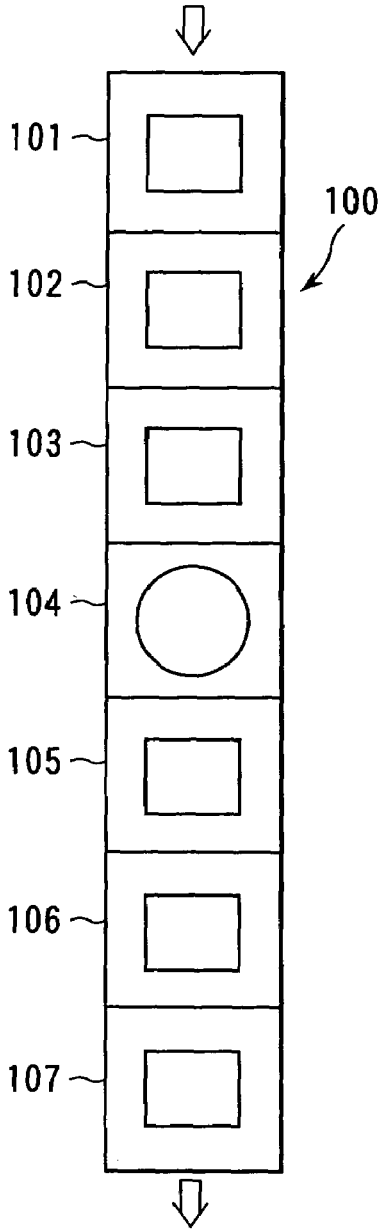
FIG. 24 is a view schematically showing a vacuum processor used in the manufacture of the FED shown in FIG. 19.

Indium for the sealing materials 34 is spread on the sealed surfaces of the rear substrate 12 having the support members 14 sealed thereon in the aforesaid manner, the front substrate 11 having the phosphor screen 15 thereon, and the sidewall 13. In doing this, indium is applied to the respective inner surfaces of the peripheral edge portions of the rear substrate 12 and the front substrate 11, for example. Thereafter, these substrates are opposed to each other with a given gap between them as they are put into a vacuum processor 100. The vacuum processor 100 shown in FIG. 24, for example, is used in the aforementioned series of processes.

The vacuum processor 100 has a loading chamber 101, baking and electron-ray cleaning chamber 102, cooling chamber 103, vapor deposition chamber 104 for getter film, assembly chamber 105, cooling chamber 106, and unloading chamber 107, which are arranged in regular order. These individual chambers are formed as processing chambers capable of vacuum processing. All the chambers are evacuated during the manufacture of the FED. Each two adjacent processing chambers are connected by means of a gate valve or the like.

The rear substrate 12, sidewall 13, and front substrate 11 are put into the loading chamber 101, and are delivered to the baking and electron-ray cleaning chamber 102 after a vacuum atmosphere is formed in the loading chamber 101. In the baking and electron-ray cleaning chamber 102, the aforesaid assembly and the front substrate are heated to the temperature of 350° C., and gas adsorbed by the surface of each member is discharged.

During the heating operation, moreover, an electron ray from an electron ray generator (not shown) that is attached to the baking and electron-ray cleaning chamber 102 is applied to the phosphor screen surface of the front substrate 11 and the electron emitting element surface of the rear substrate 12. Since this electron ray is deflected for scanning by means of a deflector that is attached to the outside of the electron ray generator, the phosphor screen surface and the electron emitting element surface can be wholly subjected entire to electron-ray cleaning.

After the heating and electron-ray cleaning operations, the assembly and the front substrate are delivered to the cooling chamber 103 and cooled to the temperature of about 100° C., for example. Subsequently, the assembly and the front substrate are delivered to the vapor deposition chamber 104 for getter film formation, whereupon a Ba film is formed as a getter film on the outside of the phosphor screen by vapor deposition. This Ba film can maintain its active state, since its surface can be prevented from being soiled by oxygen or carbon.

Subsequently, the rear substrate 12, sidewall 13, and front substrate 11 are delivered to the assembly chamber 105. In this assembly chamber 105, these members are heated to the temperature of about 130° C., for example, and the two substrates are lapped on each other in a predetermined position. As this is done, the sidewall 13 is held in a manner such that the projections 13*a*, 13*b*, 13*c* and 13*d* on the sidewall, and the rear substrate 12, sidewall 13, and front substrate 11 are positioned with respect to one another. Further, markings corresponding to the projections 13*a*, 13*b*, 13*c* and 13*d* of the sidewall 13 may be put on the rear substrate 12, for example, so that the projections and the markings can be monitored as the sidewall 13 is highly accurately aligned with the rear substrate. The projections 13*a*, 13*b*, 13*c* and 13*d* project outward from the sidewall 13. Even in the assembly chamber 105, therefore, the sidewall 13 can be easily chucked by utilizing these projections as it is transported and aligned.

Subsequently, the electrodes are brought into contact with two opposite projections, e.g., projections 13*a* and 13*c*, out of the projections 13*a*, 13*b*, 13*c* and 13*d* of the sidewall 13, a high-melting conductive member, and DC current of 300 A is supplied to the sidewall 13 for 40 seconds. Thereupon, this current also simultaneously flows through indium at the same time, so that the sidewall 13 and indium generate heat. Thus, indium is heated to about 160 to 200° C. and melted. As this is done, a force of pressure of about 50 kgf is applied to the lapped front substrate 11 and rear substrate 12 from both sides.

Thereafter, the current supply to the sidewall 13 is stopped, and heat from the sealing regions, that is, the sidewall 13 and the sealing materials 34, is quickly conducted to and diffused into the front substrate 11 and the rear substrate 12 that surround them, whereupon indium is solidified. Thus, the front substrate 11 and the rear substrate 12 are sealed together by means of the sidewall 13 and the sealing materials 34, whereupon the vacuum envelope 10 is formed. After the current supply is stopped, the vacuum envelope 10 that is sealed in about 60 seconds is carried out of the assembly chamber 105. The vacuum envelope 10 formed in this manner is cooled to the normal temperature in the cooling chamber 106 and taken out of the unloading chamber 107.

According to the FED of the fourth embodiment constructed in this manner and the manufacturing method therefor, the rear substrate 12, sidewall 13, and front substrate 11 are sealed together in the vacuum atmosphere. As this is done, the adsorbed surface gas can be fully discharged by baking combined with electron-ray cleaning, and a good effect of gas adsorption can be maintained without rendering the getter film oxidized. If a high-melting conductive member, such as an iron-nickel alloy, is used for the sidewall 13, and if the sidewall is provided with the graspable projections 13*a*, 13*b*, 13*c* and 13*d*, the sidewall 13 can be easily chucked and transported even in the vacuum device. Thus, the sidewall 13 can be aligned highly accurately with respect to its corner portions, and can be sealed in a short time.

Since current is supplied to the high-melting conductive member, moreover, there is no possibility of unevenness of the cross section of melted indium increasing when indium is melted. Therefore, indium can be prevented from breaking, and glass can be prevented from being broken by local heating. Thus, the vacuum envelope can be sealed easily and securely. Since the rear substrate 12, front substrate 11, and sidewall 13 are sealed with use of indium, moreover, a leadless image display apparatus can be formed.

Figure 25:
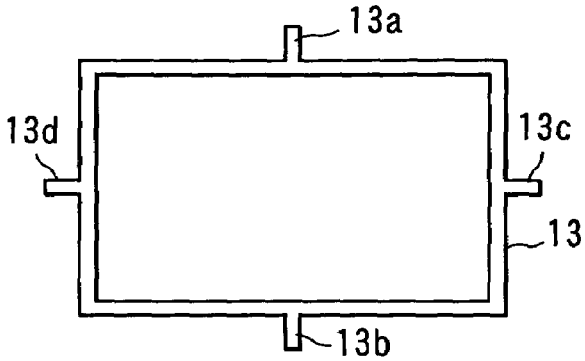
FIG. 25 is a plan view showing a sidewall of the FED according to a modification of the fourth embodiment.

The projections of the high-melting conductive member that constitutes the sidewall are not limited to the arrangement of the foregoing embodiment. More specifically, four projections should only be arranged at spaces, and they may be situated in any other positions than the corner portions of the sidewall. According to an FED of a modification of the fourth embodiment, as shown in FIG. 25, a sidewall 13 for use as a high-melting conductive member is in the form of a rectangular frame, and is provided with projections 13*a*, 13*b*, 13*c* and 13*d* that protrude individually outward from the respective central portions of the sides. Also in this case, the electrodes are brought into contact with two opposite projections 13*a* and 13*c*, and DC current is supplied. Thus, the envelope can be sealed in the same manner as in the foregoing fourth embodiment. This modification shares other configurations with the first embodiment.

In the fourth embodiment described above, the individual projections of the sidewall 13 extend close to the corner portions of the rear substrate 12. According to the FED of the modification shown in FIG. 26, however, the projections 13*a*, 13*b*, 13*c* and 13*d* of the sidewall 13 extend beyond the peripheral edge of the rear substrate 12 to the outside of the rear substrate. This modification shares other configurations with the fourth embodiment. Like reference numerals are used to designate like portions, and a detailed description of those portions is omitted. Further, the FED having the aforesaid configuration is manufactured by the same method with the foregoing fourth embodiment.

According to the modification shown in FIG. 26, the same functions and effects of the fourth embodiment can be obtained. Since the projections of the sidewall of the project outside the rear substrate, at the same time, the sidewall can be grasped and positioned more easily in the manufacturing processes.

The current supplied to the high-melting conductive member is not limited to DC current, and may alternatively be AC current in the commercial frequency band or high frequency band.

The following is a description of an FED according to a fifth embodiment of this invention and a manufacturing method and a manufacturing apparatus therefor.

As shown in FIGS. 27 and 28, this FED comprises a front substrate 11 and a rear substrate 12, which are formed of a rectangular glass material each. These substrates are opposed to each other with a gap of about 1.6 mm between them, for example. The rear substrate 12 is a little greater in size than the front substrate 11, and lead wires (not shown) for inputting picture signals (mentioned later) are formed on its outer peripheral portion. The front substrate 11 and the rear substrate 12 have their respective peripheral edge portions bonded together by means of a sealed portion 20 in the form of a substantially rectangular frame, and constitute a flat, rectangular vacuum envelope 10 that is kept vacuum inside.

The sealed portion 20 includes a rectangular frame-shaped high-melting conductive member 42 having electrical conductivity and first and second sealing materials 34*a* and 34*b*. The high-melting conductive member 42 is bonded to the peripheral portion of the front substrate 11 by means of the first sealing material 34*a* and to the peripheral portion of the rear substrate 12 by means of the second sealing material 34*b*.

The high-melting conductive member 42 has a melting or softening point (i.e., temperature suited for sealing) higher than those of the first and second sealing materials 34*a* and 34*b*, and is formed of an iron-nickel alloy, for example. Alternatively, a material that contains at least one of Fe, Cr, Ni and Al may be used for the high-melting conductive member that has electrical conductivity. Further, a material that has a melting or softening point lower than that of the second sealing material is used as the first sealing material 34*a*. In this case, indium or indium alloy is used as the first sealing material, for example, and insulating frit glass as the second sealing material.

For example, the melting or softening point of the high-melting conductive member 42 is set at 500° C. or more, the melting or softening point of the second sealing material at 300° C. or more, and the melting or softening point of the first sealing material at less than 300° C.

The present embodiment shares other configurations with the foregoing fourth embodiment. Like reference numerals are used to designate like portions, and a detailed description of those portions is omitted.

In the FED constructed in this manner, picture signals are applied to electron emitting elements 18 and gate electrodes 41 in the form of a simple matrix. Gate voltage of +100 V is applied to the electron emitting elements 18 as a reference when the luminance has its highest value. Further, +10 kV is applied to a phosphor screen 15. Thereupon, electron beams are emitted from the electron emitting elements 18. The size of the electron beams emitted from the electron emitting elements 18 is modulated by means of voltage from the gate electrodes 41, and the electron beams excite the phosphor layers of the phosphor screen 15 to luminescence, thereby displaying an image.

The following is a detailed description of the manufacturing method for the FED according to the fifth embodiment constructed in this manner.

First, the electron emitting elements 18 and various distributing wires are formed on plate glass for the rear substrate. Subsequently, plate-like support members 14 are sealed on the rear substrate 12 by means of frit glass as low-melting glass in the atmosphere. At the same time, the high-melting conductive member 42 is bonded to the peripheral portion of the rear substrate 12 by means of insulating frit glass for use as the second sealing material 34*b*. As this is done, the high-melting conductive member 42 is heated to the melting or softening point of the second sealing material 34*b*. Since its melting or softening point is higher than that of the second sealing material, however, its shape cannot be deformed. In order to secure insulation between the high-melting conductive member 42 and the wires formed on the rear substrate 12, the second sealing material 34*b* should preferably be formed to the thickness of 100 μm or more.

Usually, in this heating operation, the whole rear substrate 12 is warmed from around it. Alternatively, however, the high-melting conductive member 42 may be supplied with current so that only the sealed region is heated locally.

On the other hand, the phosphor screen 15 is formed on plate glass that is supposed to form the front substrate 11. In doing this, the plate glass that is as large as the front substrate 11 is prepared, and the stripe pattern of the phosphor layers is formed on the plate glass by means of a plotter machine. The plate glass having the phosphor strip pattern thereon and the plate glass for the front substrate are placed on a positioning jig and set on an exposure stage. As this is done, they are exposed and developed to form the phosphor screen 15. Then, a metal back layer 19, an aluminum film, is formed overlapping the phosphor screen 15.

Indium for the first sealing material 34*a* is spread on the sealed surfaces of the rear substrate 12 having the support members 14 and the high-melting conductive member 42 sealed thereon in the aforesaid manner and the front substrate 11 having the phosphor screen 15 thereon. In doing this, indium is applied to the respective inner surfaces of the peripheral portions of the high-melting conductive member 42 and the front substrate 11, for example. Thereafter, these members are opposed to each other with a given gap between them as they are put into the vacuum processor 100 shown in FIG. 24.

The rear substrate 12 and the front substrate 11 are put into the loading chamber 101, and are delivered to the baking and electron-ray cleaning chamber 102 after a vacuum atmosphere is formed in the loading chamber 101. In the baking and electron-ray cleaning chamber 102, the rear substrate 12 and the front substrate 11 are heated to the temperature of 350° C., and gas adsorbed by the surface of each member is discharged.

During the heating operation, moreover, an electron ray from the electron ray generator (not shown) that is attached to the baking and electron-ray cleaning chamber 102 is applied to the phosphor screen surface of the front substrate 11 and the electron emitting element surface of the rear substrate 12. Since this electron ray is deflected for scanning by means of the deflector that is attached to the outside of the electron ray generator, the phosphor screen surface and the electron emitting element surface can be wholly subjected entire to electron-ray cleaning.

After the heating and electron-ray cleaning operations, the rear substrate 12 and the front substrate 11 are delivered to the cooling chamber 103 and cooled to the temperature of about 100° C., for example. Subsequently, the rear substrate 12 and the front substrate 11 are delivered to the vapor deposition chamber 104 for getter film formation, whereupon a Ba film is formed as a getter film on the outside of the phosphor screen by vapor deposition.

Subsequently, the rear substrate 12 and the front substrate 11 are delivered to the assembly chamber 105. In this assembly chamber 105, these members are heated to the temperature of about 130° C., for example, and the two substrates are lapped on each other in a predetermined position. Thereafter, the electrodes are brought into contact with the high-melting conductive member 42, and DC current of 300 A is supplied for 40 seconds. Thereupon, this current also simultaneously flows through the first sealing material 34*a* or indium, so that the high-melting conductive member 42 and indium generate heat. Thus, indium is heated to about 160 to 200° C. and melted or softened. As this is done, a force of pressure of about 50 kgf is applied to the lapped front substrate 11 and rear substrate 12 from both sides.

The melting or softening point of indium is lower than that of the second sealing material 34*b*. During the aforesaid heating operation, therefore, the second sealing material 34*b* with which the high-melting conductive member 42 is bonded cannot be deformed. When the first sealing material 34*a* is melted or softened, the current supply is stopped, and heat from the high-melting conductive member 42 and indium is quickly conducted to and diffused into the front substrate 11 and the rear substrate 12 that surround them, whereupon indium is solidified. Thus, the front substrate 11 and the rear substrate 12 are sealed together by means of the high-melting conductive member 42 and the first and second sealing materials 32 and 34, whereupon the vacuum envelope 10 is formed. After the current supply is stopped, the vacuum envelope 10 that is sealed in about 60 seconds is carried out of the assembly chamber 105. The vacuum envelope 10 formed in this manner is cooled to the normal temperature in the cooling chamber 106 and taken out of the unloading chamber 107.

If the cross section of the high-melting conductive member 42 is too narrow, satisfactory heating speed may not be able to be obtained or the high-melting conductive member itself may break, in some cases. Preferably, therefore, the cross section of the high-melting conductive member should be at least 0.1 $mm^2$ or more. If the cross section is too wide, however, necessary current for heating increases.

Preferably, moreover, the high-melting conductive member 42 and the first and second sealing materials 32 and 34 should have basically the same thermal expansion coefficient with the rear substrate and the front substrate. Since the high-melting conductive member, compared with the substrates, is heated locally, however, a somewhat low thermal expansion coefficient should be selected in consideration of the residual stress. Accordingly, the thermal expansion coefficient of the high-melting conductive member 42 is set to a value lower than the maximum value in the value range of ±20% of the respective thermal expansion coefficients of the front substrate 11 and the rear substrate 12.

EXAMPLE 1

A vacuum envelope 10 that is applied to an FED display apparatus for 36-inch TV was formed. The front substrate 11 and the rear substrate 12 are formed of a glass material of 2.8-mm thickness each, while the high-melting conductive member 42 that doubles as a sidewall is formed of an Ni—Fe alloy of 2-mm width and 1.5-mm height. The high-melting conductive member 42 is bonded to the rear substrate 12 by means of frit glass of 0.2-mm thickness as the second sealing material and to the front substrate 11 by means of indium of 0.3-mm thickness as the first sealing material.

The respective coefficients of linear thermal expansion of frit glass and Ni—Fe alloy account for 97% and 95%, respectively, of the thermal expansion coefficient of the substrate glass material.

This vacuum envelope was manufactured by the following method.

First, frit glass is loaded into the rear substrate 12 or the high-melting conductive member 42 and calcinated. The rear substrate 12 and the high-melting conductive member 42 are lapped on each other in a predetermined position, and are heated and bonded together in the atmosphere at 400° C. As this is done, the thickness of the frit glass layer is adjusted to 0.2 mm in order to secure insulation between lead wires on the rear substrate 12 and the high-melting conductive member 42.

Then, the front substrate 11, high-melting conductive member 42, and sealed surfaces are loaded with indium. After the rear substrate 12 and the front substrate 11, having the high-melting conductive member 42 bonded thereto, are put into the vacuum tank and degassed by heating, a getter film is formed on the front substrate 11, and the two are lapped on each other in a predetermined position. DC current of 300 A is supplied to the high-melting conductive member 42 and indium for 40 seconds, and indium is heated to about 160 to 180° C. and melted.

As this is done, a force of pressure of about 50 kgf is applied to the lapped front substrate 11 and rear substrate 12. Thereupon, the space between the front substrate 11 and the rear substrate 12 is 2 mm, which is equal to the height of the support members 14, so that the thickness of the indium layer is 0.3 mm. Thereafter, the current supply is stopped, and heat from the sealed portion is quickly conducted to and diffused into the front substrate and the rear substrate, whereupon indium is solidified. After the current supply is stopped, the envelope that is sealed in about 60 seconds is carried out.

According to Example 1 arranged in this manner, the current supply, heating, and sealing can be carried out without suffering breaking of indium, lowering of airtightness, dislocation of the sidewall, or shorting of the lead wires, so that the mass-productivity can be improved. In this embodiment, indium and frit glass are used for the first and second sealing materials, respectively. However, any other materials may be used only if they ensure the relation that the melting or softening temperature of the first sealing material is lower than the melting or softening temperature of the second sealing material. Further, the current supplied is not limited to DC current, and may alternatively be AC current in the commercial frequency band or high frequency band.

EXAMPLE 2

Figure 29:
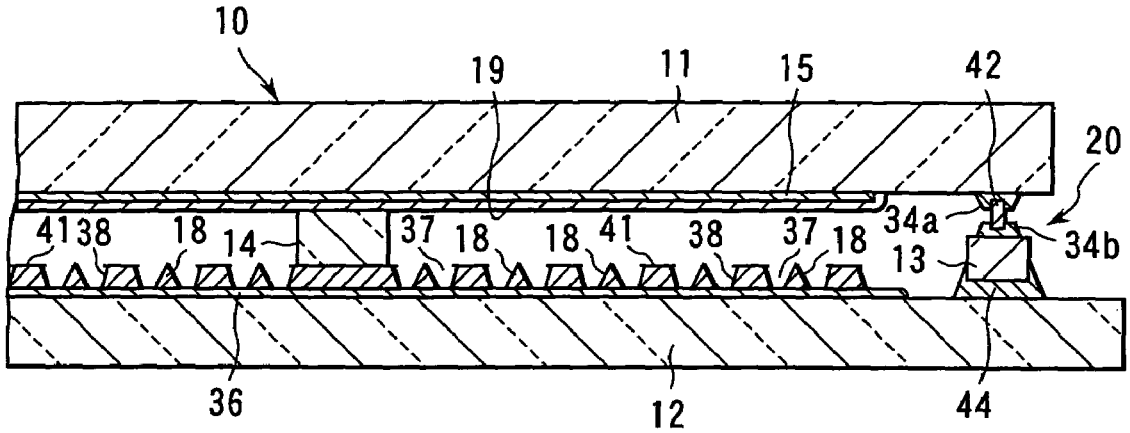
FIG. 29 is a sectional view showing an FED according to a modification of the fifth embodiment.

In the present example, as shown in FIG. 29, the sealed portion 20 that seals together the respective peripheral portions of the front substrate 11 and the rear substrate 12 includes the rectangular frame-shaped sidewall 13 that is formed of glass.

More specifically, the sidewall 13 is bonded to the peripheral portion of the rear substrate 12 by means of frit glass 44, and the frame-shaped high-melting conductive member 42 is bonded to the sidewall 13 by means of frit glass 34*b*. Further, the high-melting conductive member 42 is bonded to the peripheral portion of the front substrate 11 by means of indium 34*a*.

Including the sidewall 13, the high-melting conductive member 42 is 2 mm wide and 0.2 mm high. Accordingly, the cross section of the high-melting conductive member 42 is 0.4 $mm^2$, which is smaller than that of Example 1. Thus, necessary current for current-supply heating was able to be reduced from 300 A for Example 1 to 80 A, so that the countermeasure of a current-supply device for heat generation can be simplified.

According to the FED constructed in this manner and the method of manufacturing the FED, the high-melting conductive member can be separately sealed twice on the rear substrate and the front substrate. At the same time, current-supply-heating sealing that ensures high mass-productivity can be carried out as final sealing. Further, one substrate can be sealed to the other substrate by current-supply-heating sealing by means of the first sealing material after the high-melting conductive member is previously sealed to the one substrate by means of the second sealing material. Thus, a highly airtight sealed portion can be obtained. At the same time, the high-melting conductive member that forms the sidewall can be accurately sealed in a desired position.

Since the second sealing material is insulative, moreover, electrical insulation between the lead wires on the rear substrate and the high-melting conductive member can be ensured. Accordingly, there may be obtained an FED that can be sealed easily and securely in a vacuum atmosphere without arousing the problem of lowered airtightness or insulation of the lead wires, and a manufacturing method therefor.

In the fifth embodiment described above, both the high-melting conductive member and the front substrate are previously loaded with the first sealing material. Alternatively, however, only one of these members may be loaded with the first sealing material. Further, the first sealing material and the substrate may be subjected to suitable leveling. Furthermore, the high-melting conductive member may be bonded to the rear substrate and the front substrate by means of the first sealing material and the second sealing material, respectively.

The following is a description of an FED according to a sixth embodiment of this invention and a manufacturing method and a manufacturing apparatus therefor.

Figure 30:
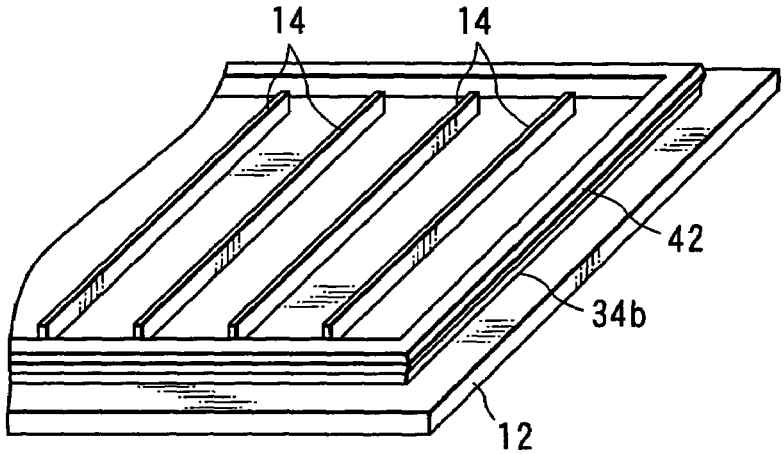
FIG. 30 is a perspective view showing an FED according to a sixth embodiment of this invention cleared of its front substrate.
Figure 31:
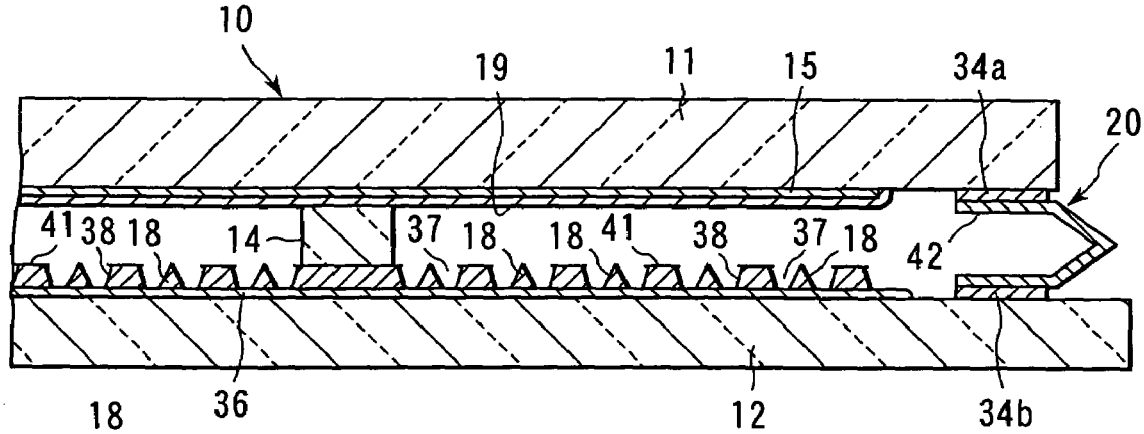
FIG. 31 is a sectional view of the FED according to the sixth embodiment.

As shown in FIGS. 30 and 31, this FED comprises a front substrate 11 and a rear substrate 12 as insulating substrates, which are formed of a rectangular glass material of 2.8-mm thickness each. These substrates are opposed to each other with a gap of about 2.0 mm between them, for example. The rear substrate 12 is a little greater in size than the front substrate 11, and lead wires (not shown) for inputting picture signals are formed on its outer peripheral portion. The front substrate 11 and the rear substrate 12 have their respective peripheral edge portions bonded together by means of a sealed portion 20 in the form of a substantially rectangular frame, and constitute a flat, rectangular vacuum envelope 10 that is kept vacuum inside.

The sealed portion 20 includes a rectangular frame-shaped high-melting conductive member 42 having electrical conductivity and first and second sealing materials 34*a* and 34*b*. The high-melting conductive member 42, which functions also as a sidewall, is bonded to the peripheral portion of the front substrate 11 by means of the first sealing material 34*a* and to the peripheral portion of the rear substrate 12 by means of the second sealing material 34*b*.

The high-melting conductive member 42 has a melting or softening point (i.e., temperature suited for sealing) higher than those of the first and second sealing materials 34*a* and 34*b*, and is formed of an iron-nickel alloy, for example. Alternatively, a material that contains at least one of Fe, Cr, Ni and Al may be used for the high-melting conductive member that has electrical conductivity. For example, indium or indium alloy is used for the first and second sealing materials 32. Preferably, the melting or softening point of the high-melting conductive member 42 should be 500° C. or more, while the melting or softening point of the first and second sealing materials 34*a* and 34*b* should be less than 300° C.

Preferably, moreover, the high-melting conductive member 42 and the first and second sealing materials 34*a* and 34*b* should have thermal expansion coefficients intermediate between the maximum and minimum values in the value range of ±20% of the respective thermal expansion coefficients of the front substrate and the rear substrate.

Further, the high-melting conductive member 42 has resilience or elasticity in a direction perpendicular to the respective surfaces of the front substrate 11 and the rear substrate 12. In the present embodiment, the high-melting conductive member 42 has a substantially V-shaped cross section. The high-melting conductive member 42, which is located between the front substrate 11 and the rear substrate 12, is slightly elastically deformed in a direction such that the angle of its V is reduced. Its elasticity applies a desired force of pressure to the respective inner surfaces of the front substrate and the rear substrate. Preferably, the high-melting conductive member 42 should be adjusted to the spring constant of about 0.1 kgf/mm to 1.0 kgf/mm.

A plurality of plate-like support members 14 are provided in the vacuum envelope 10 in order to support atmospheric load that acts on the front substrate 11 and the rear substrate 12. These support members 14 are arranged parallel to the short sides of the vacuum envelope 10 and at given spaces in the direction parallel to the long sides. The support members 14 are not limited to the shape of a plate. For example, columnar support members or the like may be used instead.

The present embodiment shares other configurations with the foregoing fourth embodiment. Like reference numerals are used to designate like portions, and a detailed description of those portions is omitted.

The following is a detailed description of the manufacturing method for the FED according to the sixth embodiment constructed in this manner.

The following is a detailed description of the manufacturing method for the FED constructed in this manner.

First, electron emitting elements 18 and various distributing wires are formed on plate glass for the rear substrate. Subsequently, the plate-like support members 14 are fixed on the rear substrate 12 by means of, for example, frit glass.

Further, a phosphor screen 15 is formed on plate glass that is supposed to form the front substrate 11. In doing this, the plate glass that is as large as the front substrate 11 is prepared, and the stripe pattern of the phosphor layers is formed on the plate glass by means of a plotter machine. The plate glass having the phosphor strip pattern thereon and the plate glass for the front substrate are placed on a positioning jig and set on an exposure stage. As this is done, they are exposed and developed to form the phosphor screen 15. Then, the metal back layer 19, an aluminum film, is formed overlapping the phosphor screen 15.

Subsequently, the respective inner peripheral portions of the front substrate 11 and the rear substrate 12, which form sealed surfaces, are loaded with frame-shaped indium for the first and second sealing materials. As this is done, the thickness of each resulting indium layer is adjusted to about 0.3 mm, which is greater than the indium layer thickness obtained after the envelope is assembled finally.

On the other hand, the high-melting conductive member 42 is a rectangular frame of 0.2-mm thickness formed of an Ni—Fe alloy, and its cross section is substantially in the form of a V, of which each side is about 15 mm wide. The coefficient of linear thermal expansion of the Ni—Fe alloy is substantially equal to the coefficient of linear thermal expansion of the glass material that forms each substrate.

Then, the front substrate 11, on which the phosphor screen 15 is formed in the aforesaid manner, and the rear substrate 12, to which the support members 14 are fixed, are opposed to each other with a given gap between them, and the high-melting conductive member 42 is located between the substrates. In this state, the substrates are put into the vacuum processor 100 shown in FIG. 24.

The rear substrate 12 and the front substrate 11 are put into the loading chamber 101, and are delivered to the baking and electron-ray cleaning chamber 102 after a vacuum atmosphere is formed in the loading chamber 101. In the baking and electron-ray cleaning chamber 102, the rear substrate 12 and the front substrate 11 are heated to the temperature of 350° C., and gas adsorbed by the surface of each member is discharged.

During the heating operation, moreover, an electron ray from the electron ray generator (not shown) that is attached to the baking and electron-ray cleaning chamber 102 is applied to the phosphor screen surface of the front substrate 11 and the electron emitting element surface of the rear substrate 12. Since this electron ray is deflected for scanning by means of the deflector that is attached to the outside of the electron ray generator, the phosphor screen surface and the electron emitting element surface can be wholly subjected to electron-ray cleaning.

After the heating and electron-ray cleaning operations, the rear substrate 12 and the front substrate 11 are delivered to the cooling chamber 103 and cooled to the temperature of about 100° C., for example. Subsequently, the rear substrate 12 and the front substrate 11 are delivered to the vapor deposition chamber 104 for getter film formation, whereupon a Ba film is formed as a getter film on the outside of the phosphor screen by vapor deposition.

Figures 32A, 32B, 32C:
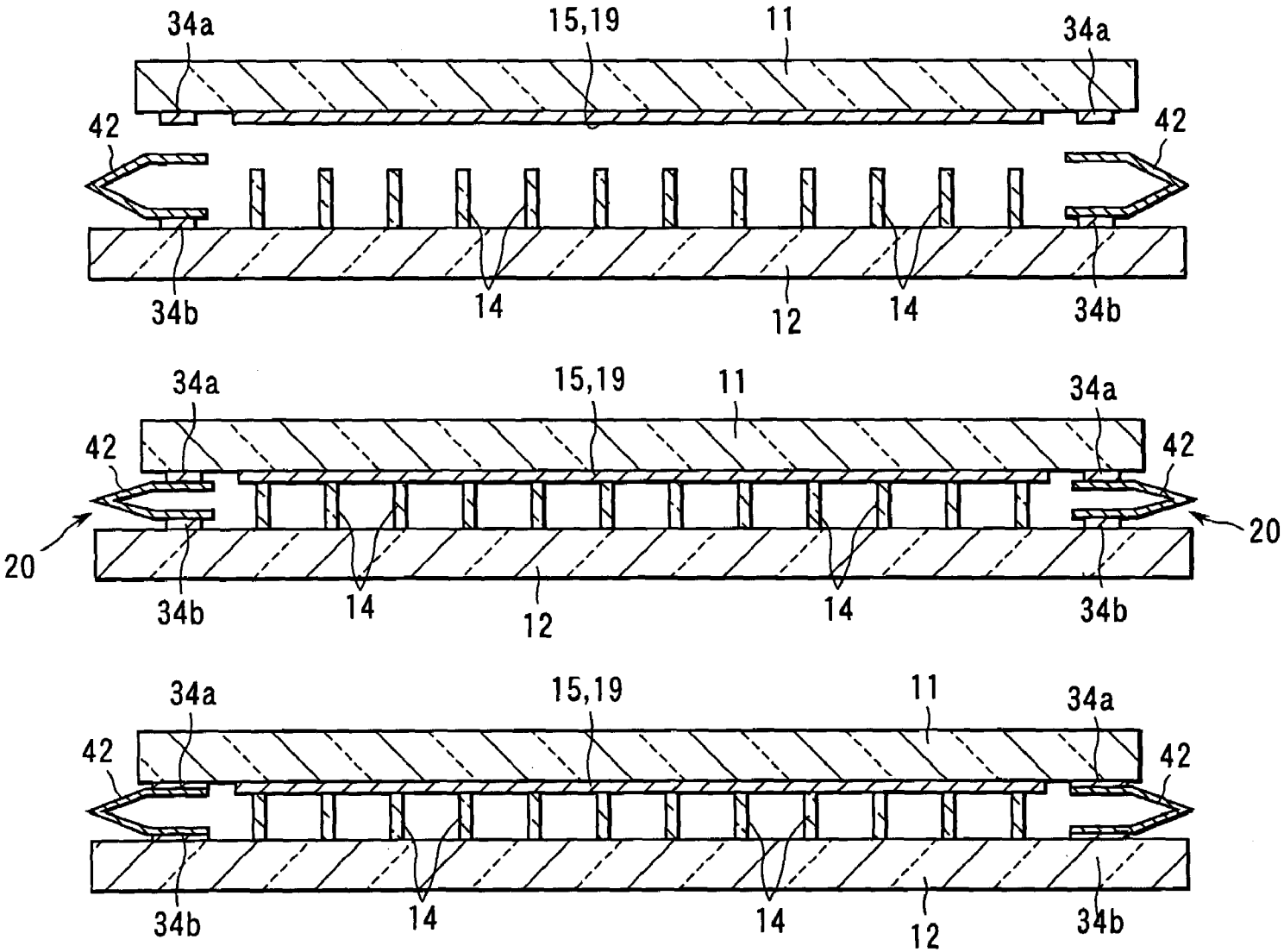
FIGS. 32A to 32C are sectional views individually showing manufacturing processes for the FED according to the sixth embodiment.

Subsequently, the rear substrate 12 and the front substrate 11 are delivered to the assembly chamber 105. In this assembly chamber 105, as shown in FIG. 32A, the front substrate 11, rear substrate 12, and high-melting conductive member 42 are aligned with one another, with the substrates heated to about 100° C., for example, that is, kept at a temperature lower than the melting or softening point of each of the first and second sealing materials 34*a* and 34*b*. At this point of time, the first and second sealing materials 34*a* and 34*b* or indium layers are in a solid state.

Until a point of time immediately before a current-supply heating process, which will be mentioned later, the front substrate 11 and the rear substrate 12 are kept at a temperature lower than the respective melting or softening points of the first and second sealing materials 34*a* and 34*b*. Preferably, the substrates are kept at a temperature such that the temperature difference from the melting point of each sealing material ranges from 20° C. to 150° C.

After the position alignment is finished, the front substrate 11 and the rear substrate 12 are lapped on each other with the high-melting conductive member 42 between them, as shown in FIG. 32B, and a force of pressure of about 50 kgf is applied to the front substrate and the rear substrate from both sides. As this is done, the V-shaped high-melting conductive member 42 is pressed from both sides by the first and second sealing materials 34*a* and 34*b* in the solid state, and are elastically deformed in a direction perpendicular to the substrates so that the angle of its V is reduced.

Thus, the thickness of the first and second sealing materials 34*a* and 34*b* that are deposited relatively thickly can be absorbed, so that the difference between the gaps between the front substrate and the rear substrate in their central portions and the sealed portion. Even in the sealed portion 20, therefore, the front substrate 11 and the rear substrate 12 cannot be warped, so that the space between the front substrate 11 and the rear substrate 12 can be kept at about 2 mm, which is equal to the height of the support members 14, throughout the area.

In this state, the electrodes are brought into contact with the high-melting conductive member 42, and DC current of 140 A is supplied for 40 seconds. Thereupon, this current also simultaneously flows through the first and second sealing materials 34*a* and 34*b* or indium, so that the high-melting conductive member 42 and indium generate heat. Thus, indium is heated to about 200° C. and melted or softened. When the first sealing material 34*a* is melted or softened, the current supply is stopped, and heat from the high-melting conductive member 42 and indium is quickly conducted to and diffused into the front substrate 11 and the rear substrate 12 that surround them, whereupon indium is solidified.

During the current-supply heating operation, the high-melting conductive member 42 presses the melted or softened indium toward the inner surface of each substrate with an appropriate spring force that is based on its own resilience or elasticity, as shown in FIG. 32C. Thus, the indium layers are slightly squeezed as they are solidified. In this case, the average thickness of the indium layers is about 0.15 mm.

Thus, the front substrate 11 and the rear substrate 12 are sealed together by means of the high-melting conductive member 42 and the first and second sealing materials 32 and 34, whereupon the vacuum envelope 10 is formed. After the current supply is stopped, the vacuum envelope 10 that is sealed in about 60 seconds is carried out of the assembly chamber 105. The vacuum envelope 10 formed in this manner is cooled to the normal temperature in the cooling chamber 106 and taken out of the unloading chamber 107.

According to the FED constructed in this manner and the manufacturing method therefor, the rear substrate and the front substrate can be sealed together in a vacuum atmosphere. At the same time, current-supply heating that ensures high mass-productivity can be used for sealing. Since the high-melting conductive member has elasticity in a direction perpendicular to the surface of each substrate, moreover, the difference between the gaps between the substrates in their central portions and the sealed portion can be removed during the sealing operation, so that the substrates can be prevented from warping at the sealed portion. Thus, the front substrate and the rear substrate can be aligned highly accurately as they are sealed together.

During the current-supply heating operation, furthermore, the high-melting conductive member can press the melted or softened sealing materials toward the substrates with an appropriate spring force. Thus, production of leakage paths that is attributable to a deficiency of the sealing materials or the like can be restrained.

In the sixth embodiment described above, the high-melting conductive member used has a V-shaped cross section. Alternatively, however, it may have a cross section of any other shape only if it has elasticity in a direction perpendicular to the respective surfaces of the front substrate and the rear substrate.

Figure 33A:
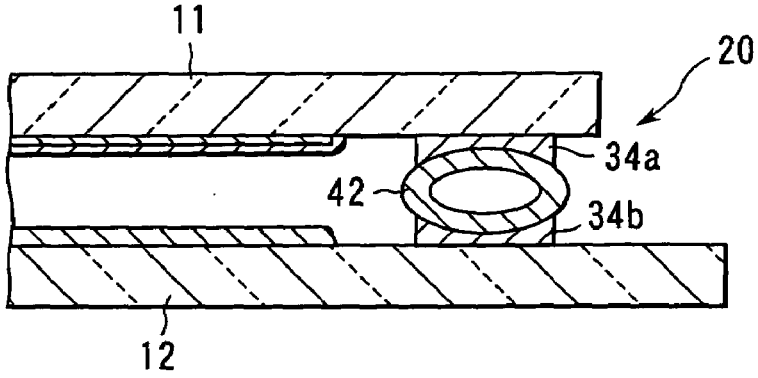
FIGS. 33A and 33B are sectional views showing an FED according to a seventh embodiment of this invention.
Figure 33B:
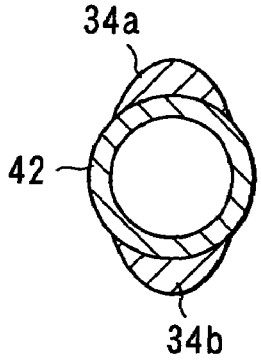

According to an FED of a seventh embodiment shown in FIGS. 33A and 33B, a pipe-shaped member of 0.12-mm thickness and 3-mm diameter that is formed of an Ni—Fe alloy is used as a high-melting conductive member 42 that constitutes a sealed portion 20. The high-melting conductive member 42 is bonded to a front substrate 11 and a rear substrate 12 by means of indium for use as first and second sealing materials 34*a* and 34*b*, respectively. The high-melting conductive member 42 has elasticity in a direction perpendicular to the respective surfaces of the front substrate 11 and the rear substrate 12.

In a sealed state, the high-melting conductive member 42 is elastically deformed or squeezed, and applies an appropriate spring force to the respective surfaces of the front substrate 11 and the rear substrate 12 at right angles to them. The present embodiment shares other configurations with the foregoing sixth embodiment, and a detailed description of those configurations is omitted.

The FED constructed in this manner is manufactured by the same method as in the foregoing sixth embodiment. If the manufacturing conditions are shared with the sixth embodiment, indium can be solidified and sealed in the following manner. DC current of 40 A is supplied to the high-melting conductive member 42 for 40 seconds to melt indium during the current-supply heating operation. Indium is cooled for 40 seconds after it is melted. Thus, the same functions and effects of the foregoing sixth embodiment can be also obtained with the seventh embodiment. Besides, the current-supply time and cooling time can be shortened, so that the efficiency of manufacture can be enhanced.

Figure 34A:
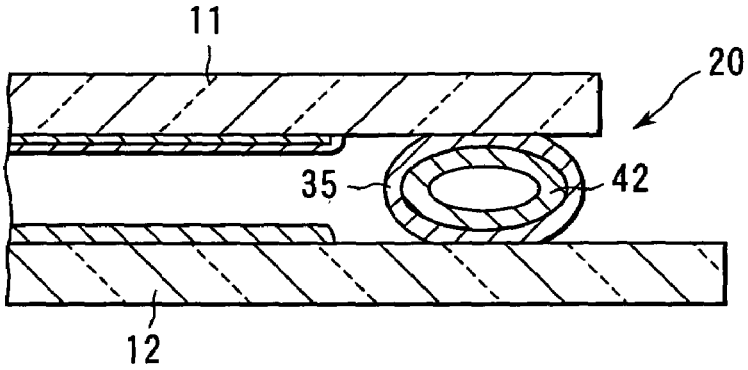
FIGS. 34A and 34B are sectional views showing an FED according to a modification of the seventh embodiment.
Figure 34B:
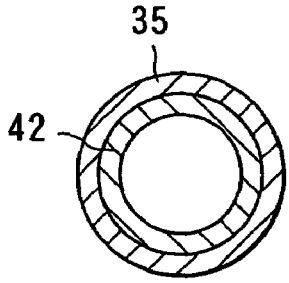

In the seventh embodiment described above, the whole outer peripheral surface of the high-melting conductive member 42 may be loaded with a sealing material 35, such as indium, as shown in FIGS. 34A and 34B. In this case, the indium loading can be completed by only immersing the high-melting conductive member 42 in an indium solder bath, so that the labor required by the manufacture can be saved. At the same time, the front substrate 11 and the rear substrate 12 can be sealed directly by means of the sealing material itself, so that the airtightness of the vacuum envelope can be improved.

This invention is not limited to the sixth embodiment described above, and various changes and modifications may be effected therein without departing from the scope of the invention. Although the substrates are loaded with the sealing material or indium according to the foregoing embodiment, for example, the high-melting conductive member may be loaded instead. Further, the current that is supplied to the high-melting conductive member is not limited to DC current, and may alternatively be AC current in the commercial frequency band or high frequency band.

In the foregoing embodiment, moreover, the high-melting conductive member is located in a predetermined position in the vacuum tank during assembly operation. Alternatively, however, it may be bonded in advance to the front substrate or the rear substrate with use of a sealing material, such as indium, in the atmosphere.

The following is a description of a manufacturing method and a manufacturing apparatus for an FED according to an eighth embodiment of this invention.

Figure 35:
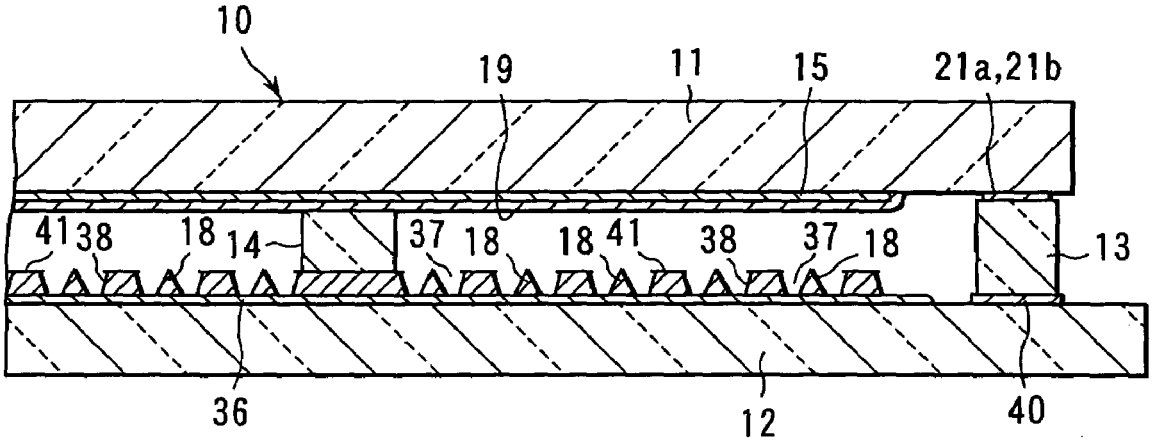
FIG. 35 is a sectional view of an FED according to an eighth embodiment of this invention.

The configuration of the FED manufactured by this manufacturing method and manufacturing apparatus will be described first. As shown in FIG. 35, the FED comprises a front substrate 11 and a rear substrate 12, which are formed of a rectangular glass material each. These substrates are opposed to each other with a gap of 1 to 2 mm between them. Its diagonal dimension is 10 inches, and the rear substrate 12 is greater than the front substrate 11. Distributing wires for inputting picture signals (mentioned later) are led out of the outer peripheral portion of the rear substrate 12.

The front substrate 11 and the rear substrate 12 have their respective peripheral edge portions bonded together by means of a sidewall 13 in the form of a rectangular frame, and constitute a flat, rectangular vacuum envelope 10 that is kept vacuum inside. The rear substrate 12 and the sidewall 13 are bonded to each other by means of frit glass 40, while the front substrate 11 and the sidewall 13 are bonded together by means of indium layers 21*a* and 21*b* for use as electrically conductive sealing materials.

A plurality of plate-like support members 14 are provided in the vacuum envelope 10 in order to support atmospheric load that acts on the front substrate 11 and the rear substrate 12. These support members 14 extend parallel to the short sides of the vacuum envelope 10 and are arranged at given spaces in the direction parallel to the long sides. The support members 14 are not limited to the shape of a plate, and columnar ones may be used instead.

The present embodiment shares other configurations with the foregoing fourth embodiment. Like reference numerals are used to designate like portions, and a detailed description of those portions is omitted.

The following is a detailed description of the manufacturing method for the FED constructed in this manner.

First, a phosphor screen 15 is formed on plate glass that is supposed to form the front substrate 11. In doing this, the plate glass that is as large as the front substrate 11 is prepared, and a stripe pattern is previously formed on the plate glass by means of a plotter machine. Then, the plate glass having the phosphor strip pattern thereon and the plate glass for the front substrate are placed on a positioning jig and set on an exposure stage. In this state, they are exposed and developed to form the phosphor screen on the glass plate that is to form the front substrate 11. Thereafter, a metal back layer 19 is formed overlapping the phosphor screen 15.

Subsequently, electron emitting elements 18 are formed on plate glass for the rear substrate 12 by the same process as in the foregoing embodiment. Thereafter, the sidewall 13 and the support members 14 are sealed on the inner surface of the rear substrate 12 by means of the frit glass 40.

Figure 36A:
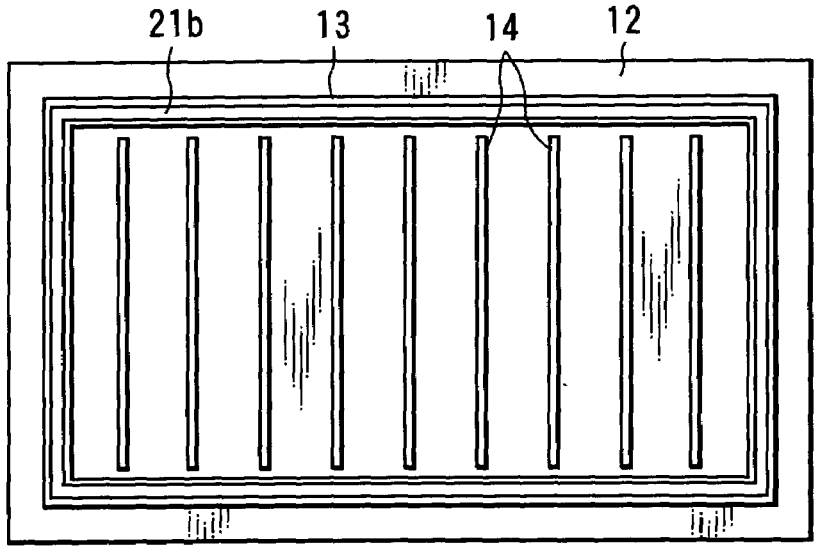
FIGS. 36A and 36B are plan views individually showing a rear substrate and a front substrate used in the manufacture of the FED shown in FIG. 35.
Figure 36B:
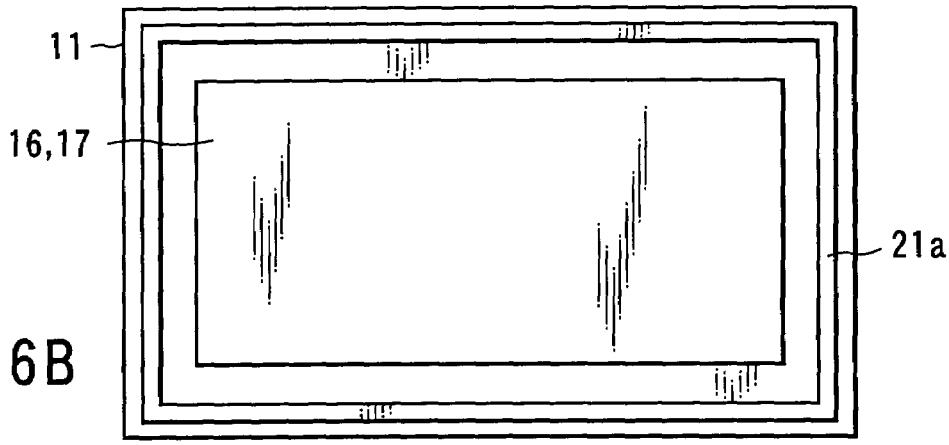
Figure 37:
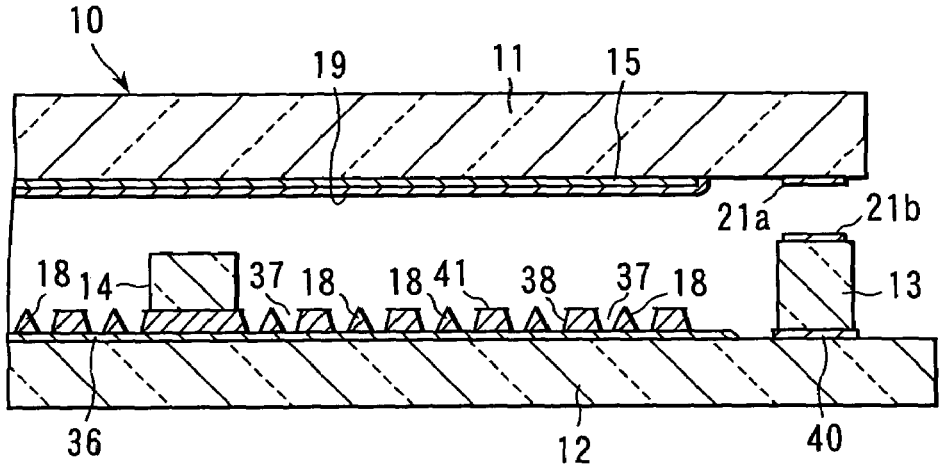
FIG. 37 is a sectional view showing the rear substrate and the front substrate opposed to each other with indium layers located in the sealed portion.

Then, the indium layer 21*b* is spread to a given width and thickness covering the whole circumference of the bonded surface of the sidewall 13, while the indium layer 21*a* is spread in the form of a rectangular frame with a given width and thickness on that part of the front substrate 11 which faces the sidewall, as shown in FIGS. 36A and 36B. As shown in FIG. 37, the rear substrate 12 and the front substrate 11 are opposed to each other at a given space as they are put into the vacuum device.

The indium layers 21*a* and 21*b* are located with respect to the respective sealed portions of the sidewall 13 and the front substrate 11 by the aforesaid method in which melted indium is spread on the sealed portions, method in which solid indium is placed on the sealed portion, etc.

Figure 38:
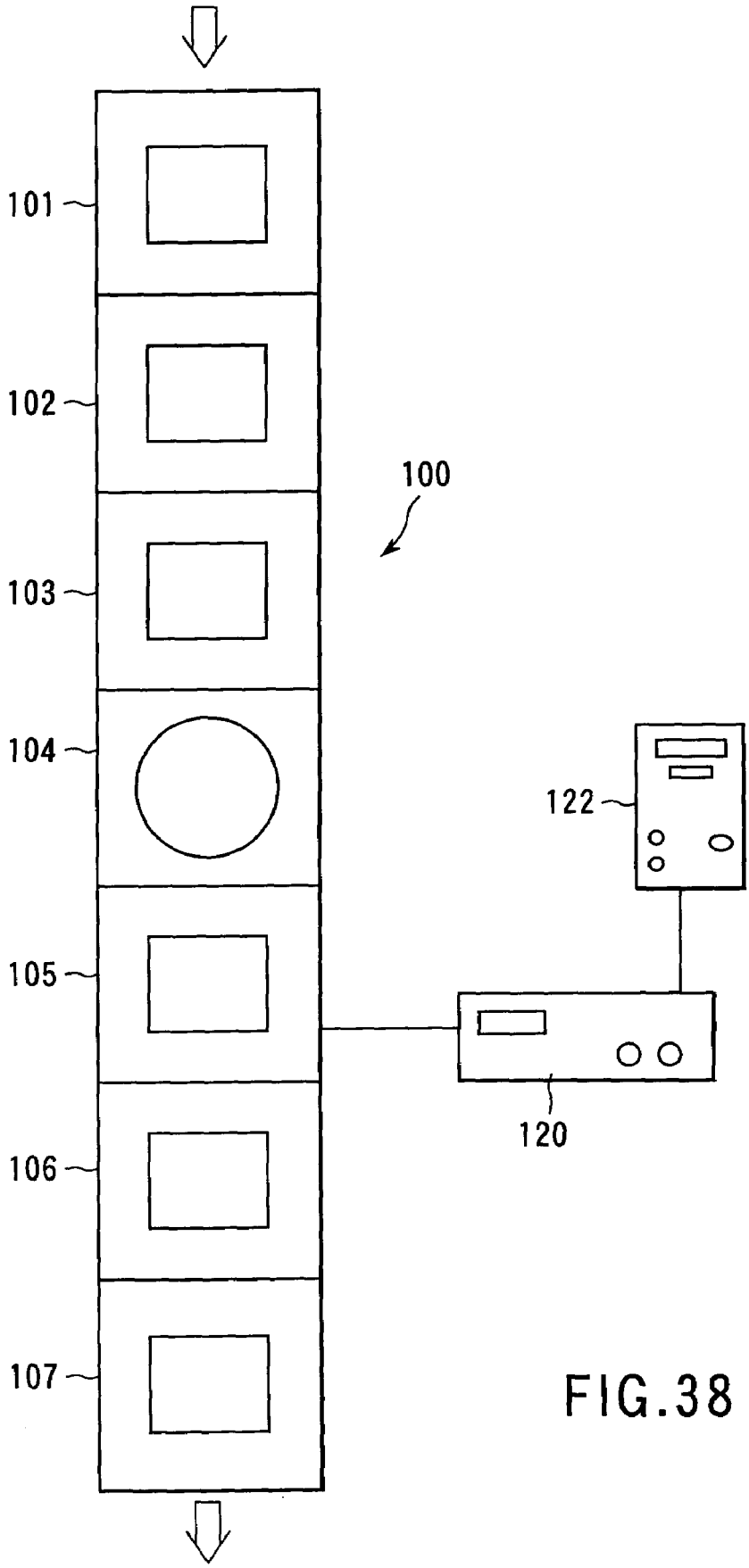
FIG. 38 is a view schematically showing a vacuum processor used in the manufacture of the FED shown in FIG. 35.

A vacuum processor 100, such as the one shown in FIG. 38, is used in this series of processes. The vacuum processor 100, like the one according to the foregoing embodiment, is provided with a loading chamber 101, baking and electron-ray cleaning chamber 102, cooling chamber 103, vapor deposition chamber 104 for getter film, assembly chamber 105, cooling chamber 106, and unloading chamber 107, which are arranged side by side. The assembly chamber 105 is connected with a DC power source 120 for current supply and a computer 122 that controls this power source. The computer 122 functions as a control section and a determining section of this invention. Further, the individual chambers of the vacuum processor 100 are formed as processing chambers capable of vacuum processing. All the chambers are evacuated during the manufacture of the FED. The processing chambers are connected by means of gate valves (not shown) or the like.

The front substrate 11 and the rear substrate 12 that are arranged at the given space are first put into the loading chamber 101. After a vacuum atmosphere is formed in the loading chamber 101, they are delivered to the baking and electron-ray cleaning chamber 102.

In the baking and electron-ray cleaning chamber 102, the various members are heated to the temperature of 300° C., and gas adsorbed by the surface of each member is discharged. At the same time, an electron ray from the electron ray generator (not shown) that is attached to the baking and electron-ray cleaning chamber 102 is applied to the phosphor screen surface of the front substrate 11 and the electron emitting element surface of the rear substrate 12. As the electron ray is deflected for scanning by means of a deflector that is attached to the outside of the electron ray generator, the phosphor screen surface and the electron emitting element surface can be wholly subjected to electron-ray cleaning.

After the heating and electron-ray cleaning operations are carried out, the front substrate 11 and the rear substrate 12 are delivered to the cooling chamber 103 and cooled to the temperature of about 120° C. Thereafter, they are delivered to the vapor deposition chamber 104 for getter film. In the vapor deposition chamber 104, a Ba film is formed as a getter film on the outside of the phosphor screen by vapor deposition. The Ba film can maintain its active state, since its surface can be prevented from being soiled by oxygen or carbon.

Figure 39:
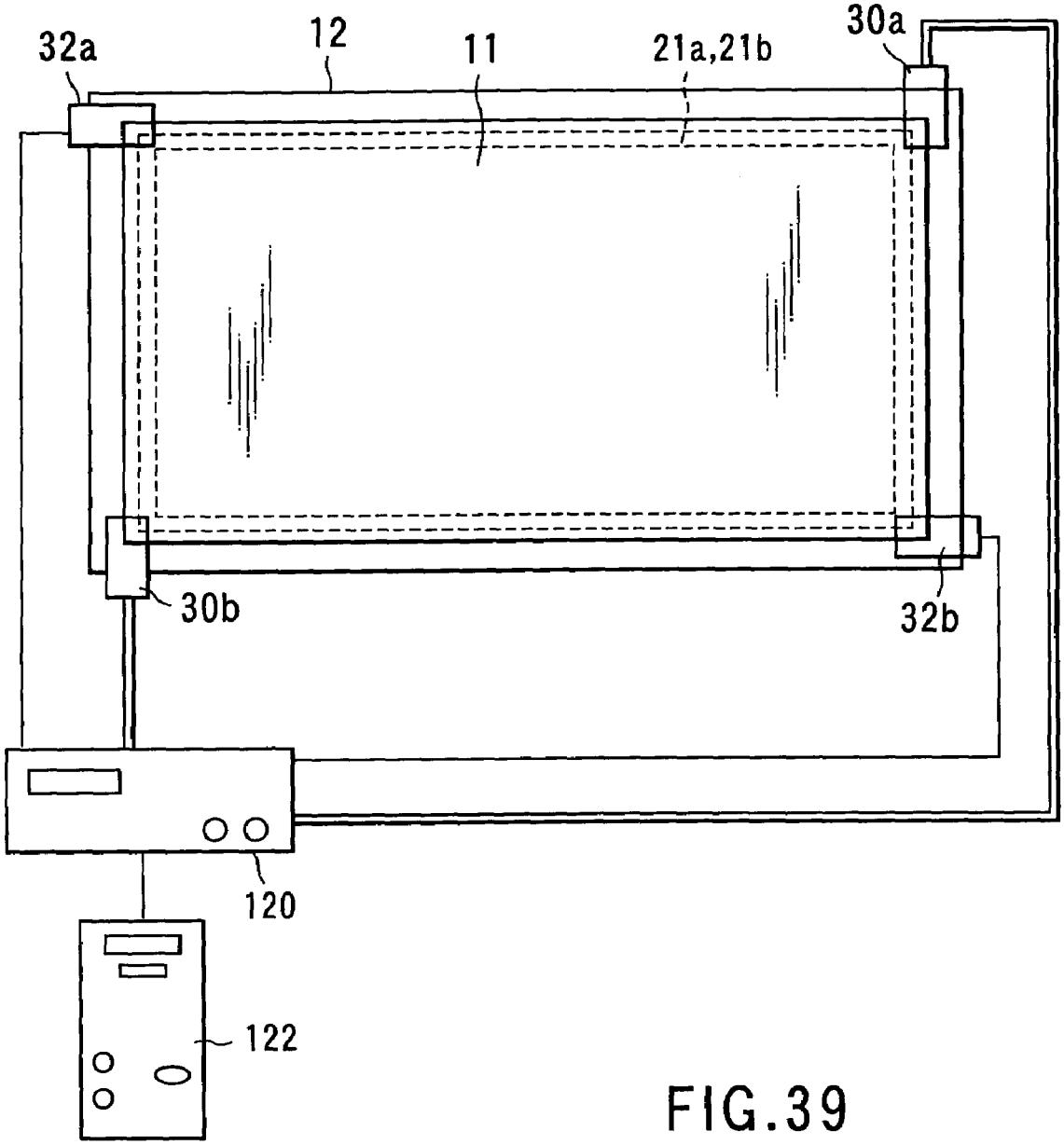
FIG. 39 is a plan view schematically showing a state in which electrodes are in contact with the indium layers in the manufacturing processes for the FED shown in FIG. 35.

Subsequently, the front substrate 11 and the rear substrate 12 are delivered to the assembly chamber 105. In this assembly chamber 105, the front substrate 11 and the rear substrate 12 are kept at the temperature of about 120° C. as electrodes for current supply are brought into contact with the respective indium layers 21*a* and 21*b* of the individual substrates. In this case, feeding terminals 30*a* and 30*b* are brought individually into contact with two diagonally opposite corner portions of the indium layer 21*a* that is formed on the front substrate 11, as shown in FIG. 39. Further, feeding terminals 32*a* and 32*b* are brought individually into contact with two diagonally opposite corner portions of the indium layer 21*b* that is formed on the sidewall 13 on the side of the rear substrate 12. The feeding terminals 30*a* and 30*b* and the feeding terminals 32*a* and 32*b* should be arranged at different corner portions without overlapping one another.

After the feeding terminals 30*a*, 30*b*, 32*a* and 32*b* are set and connected to the power source 120, current is supplied to the indium layer 21*a* on the side of the front substrate 11 and the indium layer 21*b* on the side of the rear substrate 12, thereby melting the indium layers. In this case, DC current of 70 A from the power source 120 is first applied to the indium layers 21 for one second in a constant-current mode. The constant-current mode is a mode in which current of a predetermined fixed current value is supplied. While the current is supplied for one second, a voltage value is fed back from the power source 120 and fetched by the computer 122. Thus, the one-second constant-current mode is a process for detecting the total electrical resistance based on the contact resistance and the variation of the arrangement of the indium layers 21. Thus, the contact resistance and the arrangement variation of the indium layers can be detected at a moment, and the voltage value in the next constant-current mode can be set individually to an optimum value.

In one second after the start of current supply, the measured voltage value is delivered from the computer 122 to the power source 120, whereupon a constant-voltage mode is started. The constant-voltage mode is a mode in which current is supplied with a predetermined fixed voltage value. Since the temperature of the indium layers 21*a* and 21*b* is increased by the current supply, the current value for the indium layers lowers gradually from 70 A.

Figure 40:
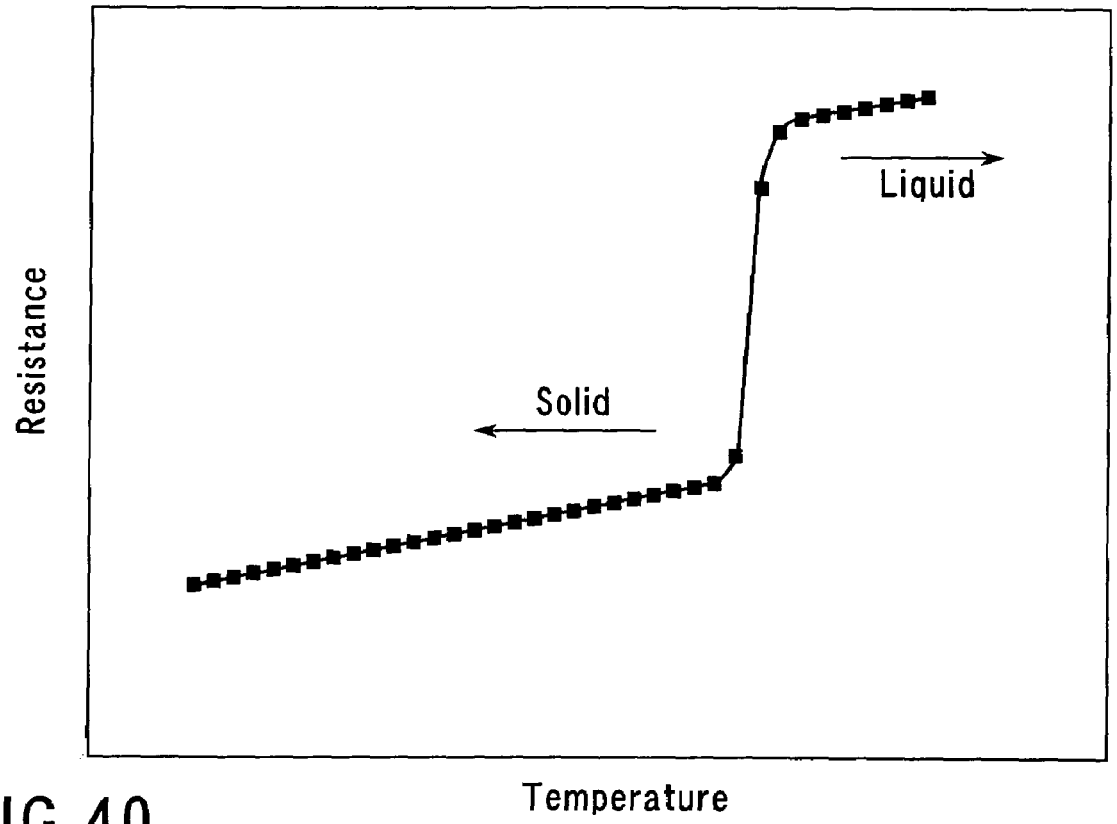
FIG. 40 is a graph showing the resistance characteristic of the indium layers compared with the change of temperature.
Figure 41:
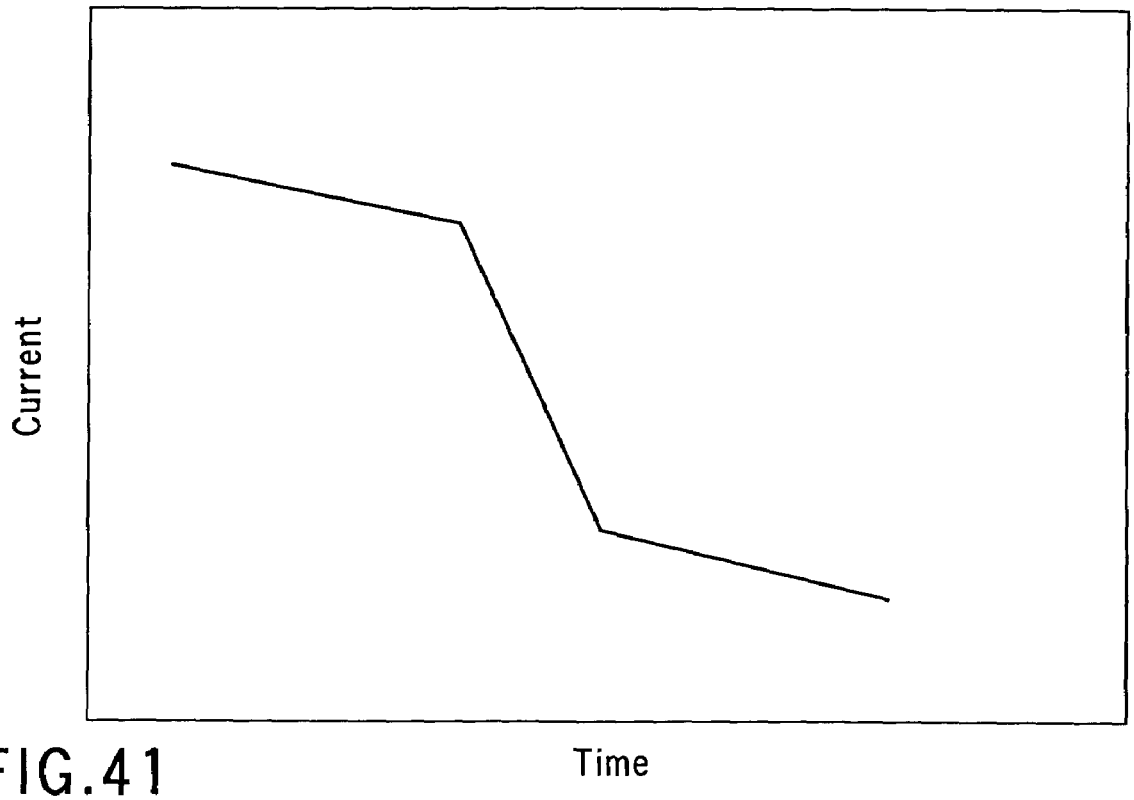
FIG. 41 is a graph showing the change of current observed during current-supply heating of the indium layers.

The electrical resistance of the indium layers 21*a* and 21*b* has the characteristic shown in FIG. 40. In those solid regions of the indium layers 21*a* and 21*b* of which the temperature is lower than the melting point, the resistance value increases gently in a linear-function fashion as the temperature rises. When the melting point is reached, the resistance value increases at a stroke. In the liquid regions of which the temperature is higher than the melting point, the resistance value increases gently in a linear-function fashion. Thus, the current value fetched from the power source 120 by the computer 122 changes substantially in the manner shown in FIG. 41.

Figure 42:
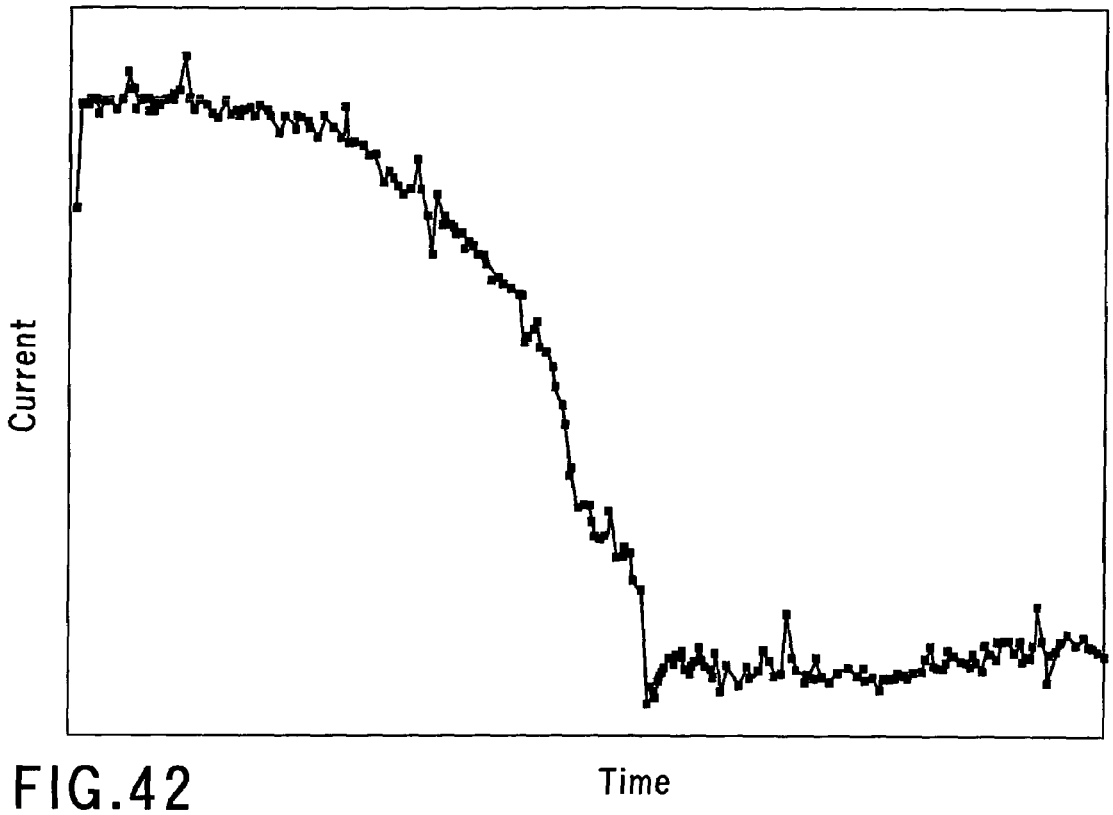
FIG. 42 is a graph showing a measured value of current obtained during the current-supply heating of the indium layers.

FIG. 42 is a graph showing a measured current value. The current value that initially lowers little by little is reduced drastically as the indium layers 21*a* and 21*b* melt. It hardly lowers after the melting. Thus, whether or not the indium layers 21*a* and 21*b* are melted entirely can be determined by monitoring the inclination of the change of the current value fetched by the computer 122 or by monitoring the reduction of the current value.

Figure 43:
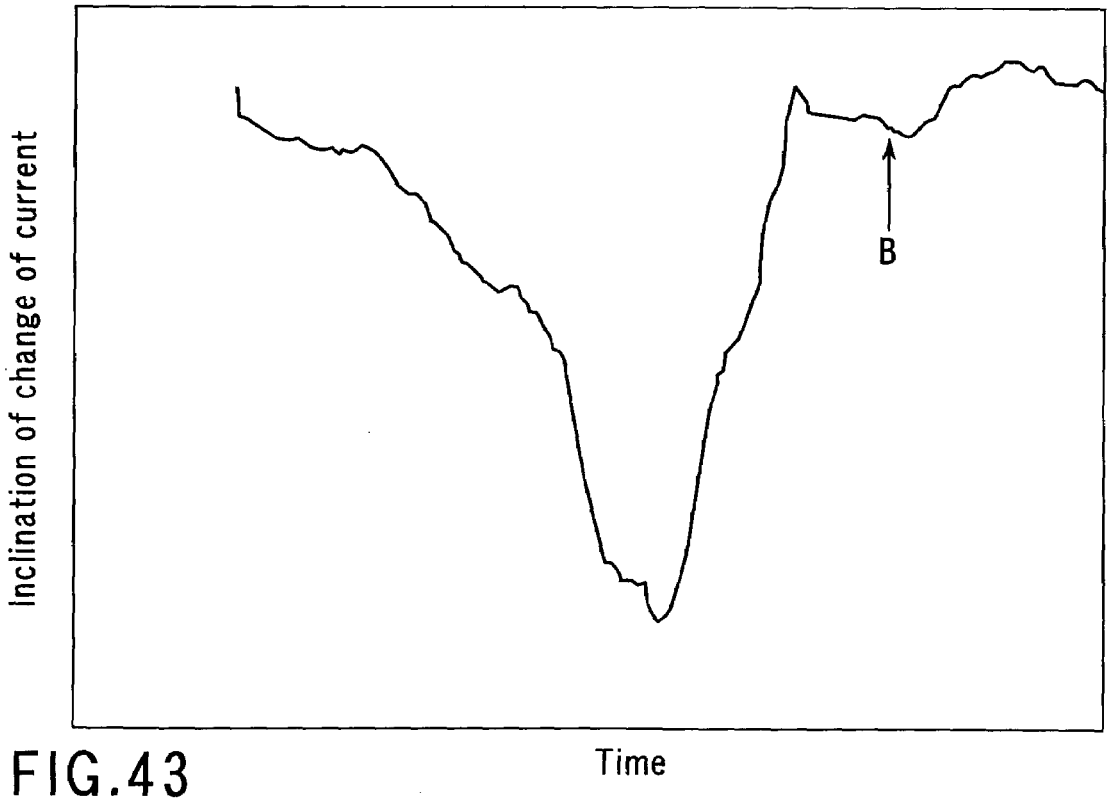
FIG. 43 is a graph showing the inclination of the change of current observed during the current-supply heating of the indium layers.

FIG. 43 shows a graphic representation of the inclination of the current value change shown in FIG. 42. The indium layers 21*a* and 21*b* are fully melted in a region B where the change of the inclination starts. Accordingly, the completion of melting of the indium layers 21*a* and 21*b* is determined by monitoring the change of the inclination of the current value change by means of the computer 122, and the current supply from the power source 120 to the indium layers 21*a* and 21*b* is stopped. For example, the current supply is stopped in 3 seconds of continuation of a state such that the inclination of the current value change is 0.5 or less.

Thereafter, the feeding terminals 30*a*, 30*b*, 32*a* and 32*b* that are kept in contact with the indium layers 21*a* and 21*b* are removed, and the front substrate 11 and the rear substrate 12 are pressurized toward each other. Thereupon, the peripheral edge portion of the front substrate 11 and the sidewall 13 are sealed and bonded together by means of indium. Alternatively, projecting portions of the electrodes may be cut off after the feeding terminals 30*a*, 30*b*, 32*a* and 32*b* are temporarily sealed together with the indium layers 21*a* and 21*b* without being removed.

The sealing time can be shortened considerably by sealing and bonding together the respective peripheral edge portions of the front substrate 11 and the rear substrate 12 by the aforesaid method. In present embodiment, it takes about 15 seconds for the indium layers 21*a* and 21*b* to be melted, and it takes about 2 minutes for indium to be solidified and cooled to 130° C. or less after the pressurization.

The vacuum envelope 10 formed in these processes is cooled to the normal temperature in the cooling chamber 106 and taken out of the unloading chamber 107. Thereupon, the FED is completed.

According to the manufacturing method for the FED described above, the front substrate 11 and the rear substrate 12 are sealed and bonded together in the vacuum atmosphere. Therefore, gas adsorbed by the surface can be fully discharged by combining baking and electron-ray cleaning, so that a getter film with high adsorption capacity can be obtained. Since the front substrate and the rear substrate are sealed and bonded together by subjecting indium to current-supply heating, moreover, they need not be heated entirely, and there is no possibility of the quality of the getter film being lowered or the substrates cracking. At the same time, the sealing time can be shortened.

In the eighth embodiment, moreover, the completion of melting of indium can be electrically detected by monitoring the change of the inclination of the current value as indium is subjected to current-supply heating. Accordingly, the current supply conditions, stopping of current supply, etc. can be set appropriately, and the bonding can be easily completed in several minutes. Thus, the manufacturing method ensures high mass-productivity. At the same time, the FED that can provide stable, satisfactory images can be manufactured at low cost.

If the substrates are relatively small in size, as in the present embodiment, the arrangement variation of the indium layers 21*a* and 21*b* influences less, so that the completion of melting of the indium layers can be determined by measuring the current value itself. The following is a description of a method according to a ninth embodiment, in which change of the current value itself is measured as an FED of the same size with the aforesaid one is sealed.

In the ninth embodiment, the indium layers 21*a* and 21*b* are spread on the sidewall 13 and that part of the front substrate 11 which faces the sidewall so that the coating width and coating thickness of the indium layers 21*a* and 21*b* are 4 mm and 0.2 mm, respectively. These dimensions are necessary dimensions for satisfactory vacuum airtightness and strength characteristic of a vacuum envelope to be formed. In this configuration, the resistance value of the indium layers 21*a* and 21*b* at 120° is about 27 mΩ. Further, the resistance value of the indium layers 21*a* and 21*b* in a melted state is about 60 mΩ.

In the ninth embodiment, as in the foregoing eighth embodiment, the feeding terminals 30*a*, 30*b*, 32*a* and 32*b* are first brought individually into contact with the indium layers 21. Thereafter, DC current of 70 A is applied to the individual indium layers 21 for one second in a constant-current mode. Subsequently, the current supply mode is switched over to a constant-voltage mode with a voltage value measured by means of the computer 122. Thereupon, the current value lowers by about 35 A. In consideration of variation, the value for the determination of the completion of melting of indium is set to a value above a theoretical value. The current value fetched from the power source 120 by the computer 122 is monitored, and the current supply is cut off in 2 to 5 seconds after the determination value is reached by the current value. Thereupon, the indium layers can be melted entirely.

In the case of the embodiment described above, the front substrate and the rear substrate are relatively small in size. If the size of each substrate is thus small, the variation of the indium layers influences less, so that the entire indium layers melt substantially simultaneously during current-supply heating operation. If the substrates are large-sized, however, the variation of the indium layers influences more. During the current-supply heating operation, therefore, a phenomenon may possibly occur such that some parts of the indium layers are melted, while other parts remain solid.

The value of the current applied to the indium layers lowers in the constant-voltage mode. If solid parts remain in the indium layers, therefore, they cannot be heated well enough to melt, so that it takes much time for the indium layers to melt entirely. If the substrates are large-sized, therefore, the completion of melting of indium should preferably be determined in the constant-current mode.

The following is a description of a manufacturing method according to a tenth embodiment for an FED of which the diagonal dimension is 32 inches and in which the space between the front substrate 11 and the rear substrate 12 is 1.6 mm. According to this method, the inclination of a voltage value is measured as the substrates are sealed and bonded together.

After the front substrate 11 and the rear substrate 12 are first subjected to desired processing, as in the foregoing eighth embodiment, these substrates are opposed to each other with a gap between them as they are put into the vacuum processor 100. In the assembly chamber 105, the front substrate 11 and the rear substrate 12 are kept at the temperature of about 120° C. as the feeding terminals 30*a*, 30*b*, 32*a* and 32*b* for current supply are brought individually into contact with the opposite corner portions of the indium layer 21 on the sidewall 13 and the opposite corner portions of the indium layer on the front substrate 11.

Figure 44:
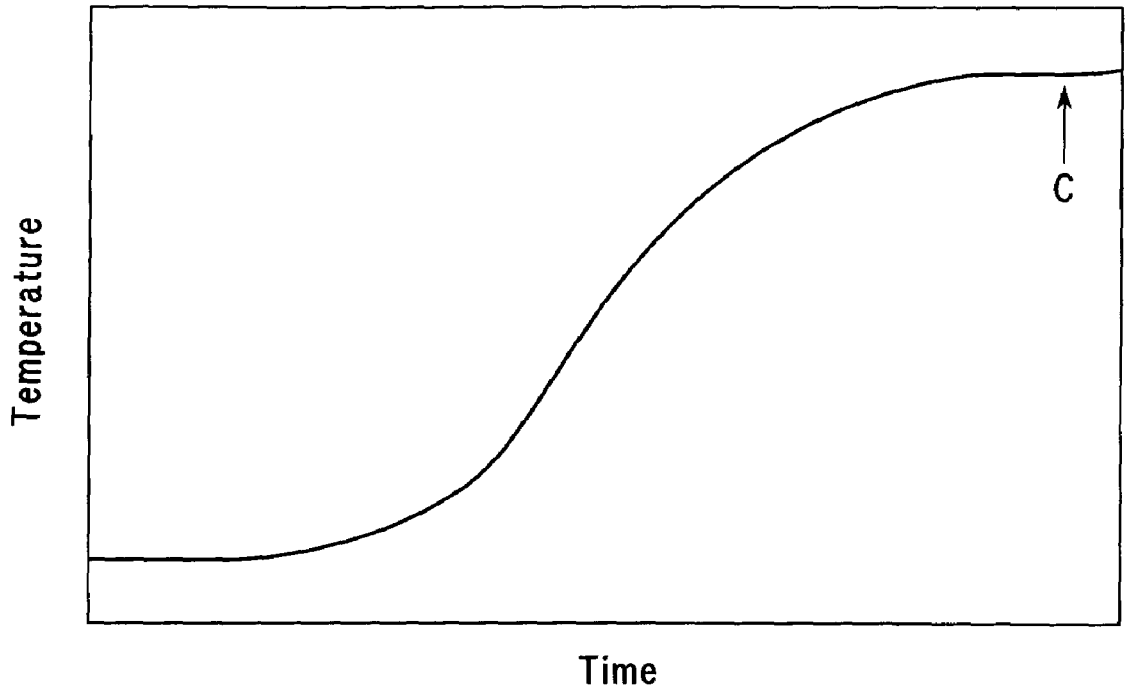
FIG. 44 is a graph showing the change voltage observed during the current-supply heating of the indium layers.
Figure 45:
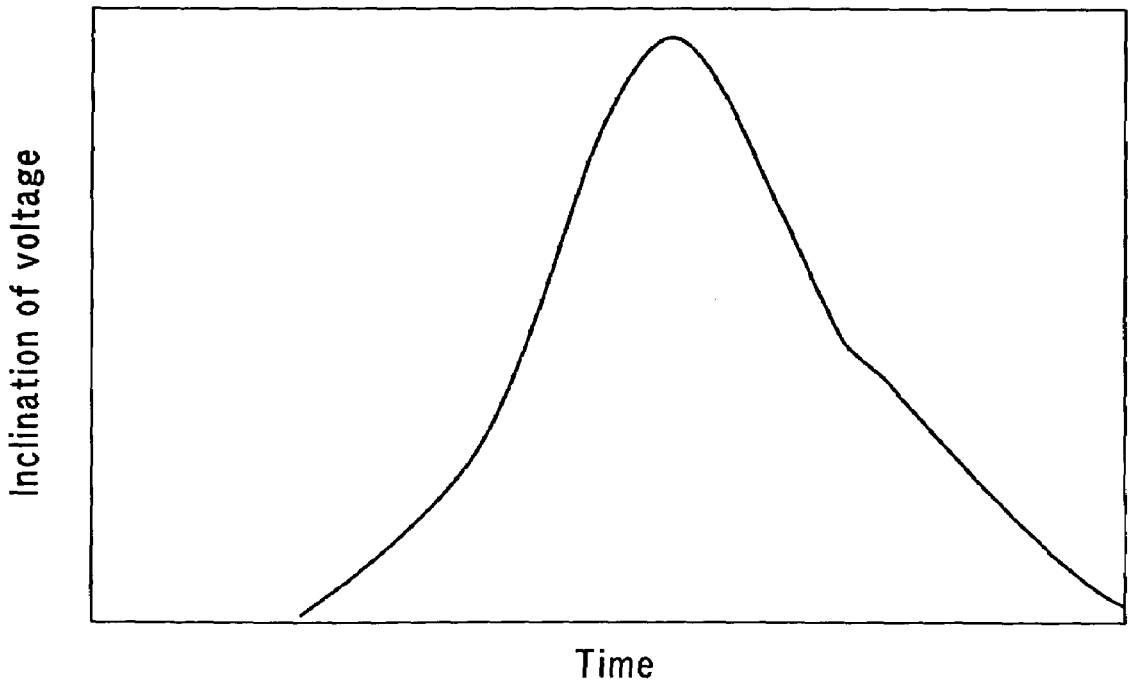
FIG. 45 is a graph showing the inclination of the change of current observed during the current-supply heating of the indium layers.

Subsequently, current is supplied from the power source 120 to the individual indium layers through the feeding terminals 30*a*, 30*b*, 32*a* and 32*b*. Since the temperature of the indium layers 21 is raised by this current supply, the voltage value fetched by the computer 122 increases gradually. FIG. 44 shows the change of the measured voltage value of the indium layers 21, and FIG. 45 shows the inclination of the corresponding voltage value. As seen from FIG. 44, the voltage value that initially increases little by little increases drastically as the indium layers 21 melt, and it increases at a lower rate after the melting. Thus, whether or not the indium layers are melted entirely can be determined by monitoring the inclination of the change of the voltage value or the increase of the voltage value. In the present embodiment, the indium layers are fully melted in a portion C where the change of the inclination terminates. Accordingly, the inclination of the voltage value change is monitored, the completion of melting of indium is determined in 5 seconds of continuation of a state such that the inclination is 0.1 or less, and the current supply is cut off.

In the present embodiment, it takes about 25 seconds for the indium layers 21*a* and 21*b* to be melted, and it takes about 3.5 minutes for indium to be solidified and cooled to 130° C. or less after the front substrate 11 and the rear substrate 12 are pressurized together.

In the embodiment described above, moreover, the completion of melting of the indium layers is determined by the change of the current value or voltage value. It is to be understood, however, that the completion of melting can be determined in accordance with the resistance value of the indium layers. The following is a description of an FED manufacturing method according to an eleventh embodiment, in which the completion of melting of indium is determined by monitoring the resistance value. In the present embodiment, the indium layer 21*b* on the sidewall 13 and the indium layer 21*a* on the front substrate 11 are subjected to current-supply heating in the assembly chamber 105 by the same process as in the first embodiment. By doing this, the front substrate and the rear substrate 12 are bonded together.

Figure 46:
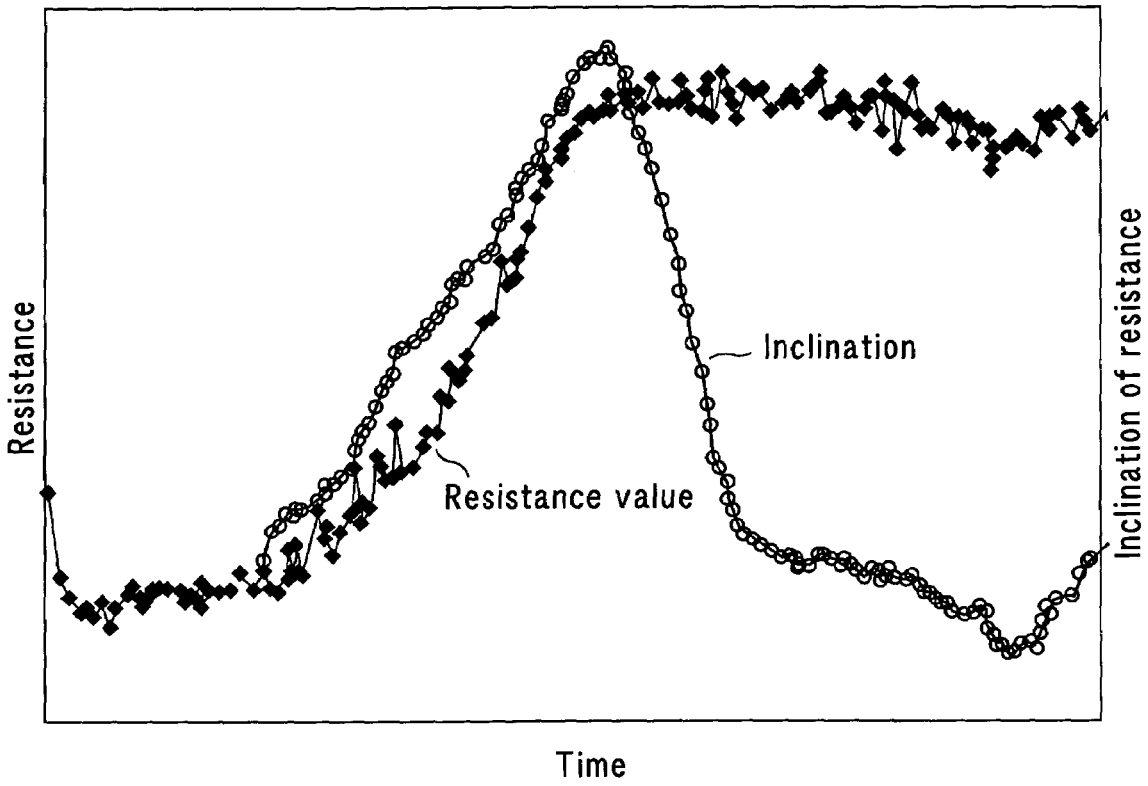
FIG. 46 is a graph showing the change of a resistance value and the inclination of the resistance value change observed during the current-supply heating of the indium layers.

During the current-supply heating of the indium layers 21, the resistance of the indium layers that is fetched from the power source 120 by the computer 122 is monitored. FIG. 46 shows the change of the resistance value and the inclination of the resistance value change. The completion of melting of the indium layers is determined in accordance with the increase of the resistance value or the inclination of the resistance value change. For example, the completion of melting of the indium layers is determined in 5 seconds of continuation of a state such that the inclination of the resistance value change is 0.5 or less, and the current-supply heating of the indium layers is stopped.

Thus, the same functions and effects of the foregoing first embodiment can be also obtained with the eleventh embodiment.

The following is a description of a twelfth embodiment of this invention.

In the present embodiment, the indium layer 21 on the sidewall 13 and the indium layer 21 on the front substrate 11 are subjected to current-supply heating in the assembly chamber 105 by the same process as in the eighth embodiment. By doing this, the front substrate and the rear substrate 12 are bonded together.

Figure 47:
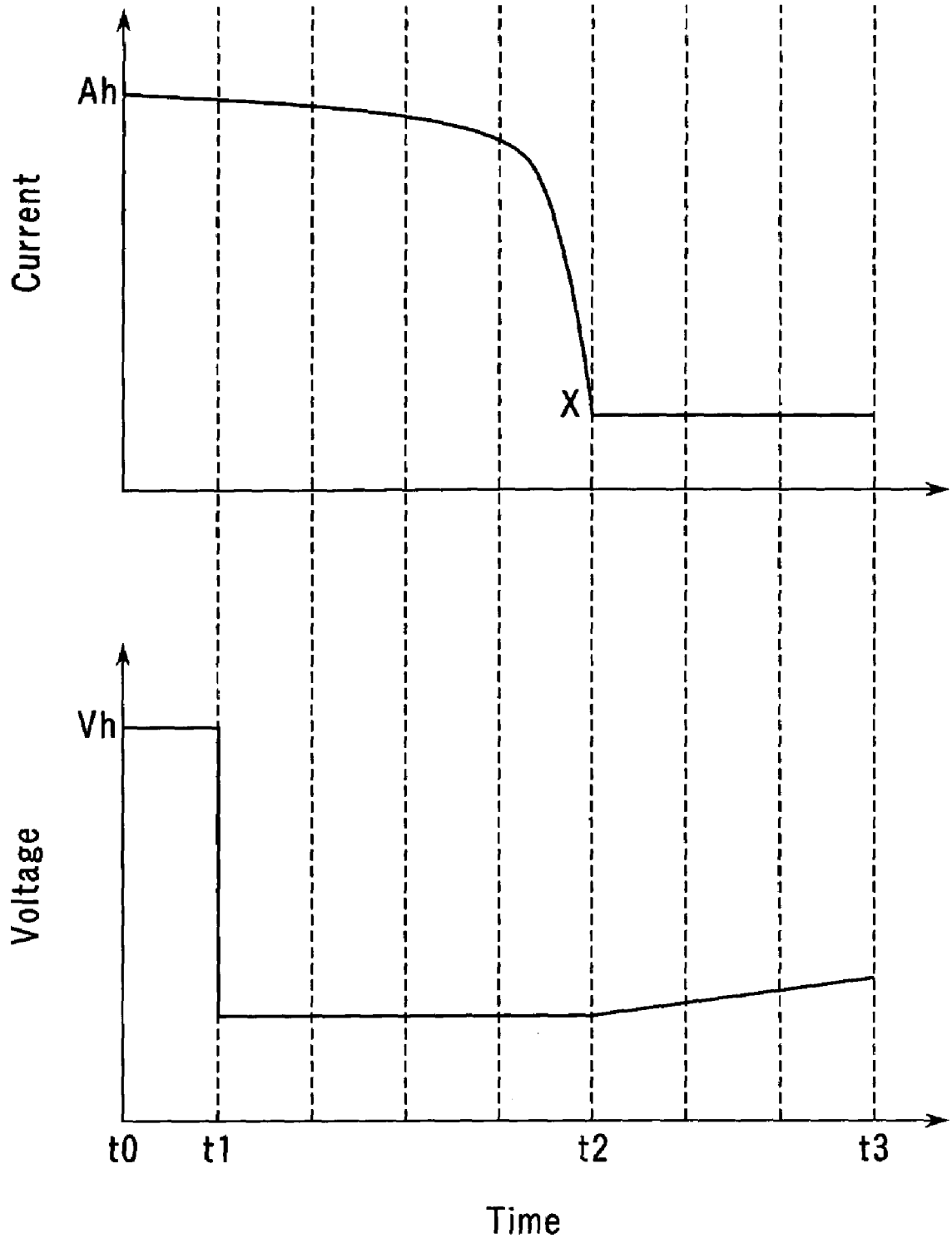
FIG. 47 is a graph showing the changes of current and voltage observed during the current-supply heating of the indium layers.

As this is done, DC current from the power source 120 is applied to the individual indium layers 21 for one second in the constant-current mode. During this one-second current supply, the current value is fed back and fetched by the computer 122. In one second (t1), as shown in FIG. 47, the measured voltage value is delivered from the computer 122 to the power source 120, whereupon a constant-voltage mode (t1–t2) is started.

Thereafter, the constant-current mode (t2–t3) is started again when the measured current value reaches a theoretical current value X that is settled by the size of the indium layers 21, that is, a theoretical current value with which the indium layers melt. After current is supplied to the indium layers 21 for a given time in the constant-current mode, the current supply is stopped. In this third-step constant-current mode, variation of the arrangement of the indium layers 21 is absorbed. This is an effective step for the secure melting of the whole indium layers.

Also in the twelfth embodiment arranged in this manner, the current supply conditions, stopping of current supply, etc. can be set appropriately as indium is subjected to current-supply heating, and the bonding can be easily completed in several minutes. Thus, the manufacturing method ensures high mass-productivity. At the same time, the FED can be manufactured at low cost, and the obtained FED can provide stable, satisfactory images.

In the above description of the ninth to twelfth embodiments, like reference numerals are used to designate like portions that are used in the eighth embodiment, and a detailed description of those portions is omitted.

This invention is not limited to the embodiments described above, and various changes and modifications may be effected therein without departing from the scope of the invention. For example, the conditions for the current supply to indium and temperature conditions may take various values without departing from the spirit of the invention. Preferably, however, the substrate heating temperature should not be higher than 140° C. lest the adsorption capacity of the getter be lowered. In the embodiments described above, the feedback from the power source is measured by means of the computer. Alternatively, however, it may be measured by means of any other measuring device, such as an ammeter or voltmeter.

It is to be understood that the external shape of the vacuum envelope and the configuration of the support members are not limited to the foregoing embodiments. Alternatively, a black light absorbing layer and phosphor layers may be formed in a matrix. In this case, columnar support members having a crucial cross section is positioned with respect to the black light absorbing layer as they are sealed. Further, the electron emitting elements may be pn-type cold cathode elements or electron emitting elements of the surface-conduction type. Although the process of bonding the substrates in a vacuum atmosphere has been described in connection with the foregoing embodiments, the present invention may be also applied to bonding in any other ambient atmosphere.

The sealing material is not limited to indium, and may be any other material that is electrically conductive. If it is a metal, in general, the resistance value changes suddenly as a phase change occurs, so that the same method of the foregoing embodiments can be carried out. For example, a metal that contains at least one of In, Sn, Pb, Ga and Bi.

Further, this invention is not limited to an image display apparatus that requires a vacuum envelope, such as an FED or SED, and may be also effectively applied to any other image display apparatus, such as a PDP that is temporarily evacuated before it is injected with discharge gas.

What is claimed is:

1. A method of manufacturing an image display apparatus which comprises an envelope having a front substrate and a rear substrate opposed to each other and individually having peripheral edge portions sealed together, the method comprising:

arranging an electrically conductive sealing member along a sealed portion between the respective peripheral edge portions of the front substrate and the rear substrate; and sealing the sealed portion by supplying current through the sealing member so as to melt the sealing member by means of the current passing through the sealing member.

2. A method of manufacturing an image display apparatus according to claim 1, which comprises arranging a frame-shaped sidewall between the respective peripheral edge portions of the front substrate and the rear substrate, and providing said sealing member between the sidewall and at least one of the front and rear substrates, and supplying current through the sealing member so to melt the sealing member.

3. A method of manufacturing an image display apparatus according to claim 1, wherein the sealing member is supplied with DC current.

4. A method of manufacturing an image display apparatus according to claim 1, wherein the sealing member is supplied with AC current in the commercial frequency band.

5. A method of manufacturing an image display apparatus according to claim 1, wherein the sealing member is supplied with AC current in the frequency band higher than the commercial frequency band from a source of AC current supply.

6. A method of manufacturing an image display apparatus according to claim 1, wherein In or an alloy containing In is used as the sealing member.

7. A method of manufacturing an image display apparatus according to claim 1, wherein the sealing member is arranged in the form of a frame along the sealed portion on the peripheral edge of the envelope and is formed having two electrode portions protruding outward from the sealed portion, the sealing member being supplied with current through the electrode portions.

8. A method of manufacturing an image display apparatus according to claim 7, wherein the cross section of each of the electrode portion is greater than the cross section of any other portion of the sealing member.

9. A method of manufacturing an image display apparatus according to claim 7, wherein the two electrode portions are arranged individually in positions symmetrical with respect to the peripheral edge portions of the envelope.

10. A method of manufacturing an image display apparatus according to claim 1, which comprises setting the temperature of the front substrate and the rear substrate to be lower than the melting point of the sealing member at a point of time immediately before supplying current through the sealing member.

11. A method of manufacturing an image display apparatus according to claim 10, wherein the difference between the melting point of the sealing member and the temperature of the front substrate and the rear substrate at the point of time immediately before the sealing member is supplied with current is set within the range from 20° C. to 150° C.

12. A method of manufacturing an image display apparatus according to claim 1, wherein the sealing the sealed portion includes supplying current through the sealing member while arranging the envelope in a vacuum atmosphere.

13. A manufacturing method for an image display apparatus according to claim 12, wherein the front substrate and the rear substrate are cooled to a temperature lower than the melting point of the sealing member without failing to maintain the vacuum atmosphere after the substrates are heated and degassed in the vacuum atmosphere, the sealing member is supplied with current to heat and melt the sealing member only, and the current supply to the sealing member is stopped so that heat from the sealing member can be conducted to the front substrate and the rear substrate to cool and solidify the sealing member, whereby the envelope is sealed.

14. A manufacturing method for an image display apparatus according to claim 13, wherein the peripheral edge portion of the front substrate or the rear substrate is released from mechanical restraint when the sealing member is supplied with current, so that the peripheral edge portion is allowed to be bent by heat as the envelope is sealed.

15. A manufacturing method for an image display apparatus according to claim 12, wherein an electron source and a phosphor are arranged in the envelope as the peripheral edge portion of front substrate or the rear substrate is sealed, whereby the envelope is kept vacuum inside.

* * * * *